US007063927B2

(12) United States Patent
Ninomiya et al.

(10) Patent No.: US 7,063,927 B2
(45) Date of Patent: Jun. 20, 2006

(54) TONER FOR ELECTROSTATIC LATENT IMAGE DEVELOPMENT, ELECTROSTATIC LATENT IMAGE DEVELOPER, PROCESS FOR PREPARING TONER FOR ELECTROSTATIC LATENT IMAGE DEVELOPMENT, AND IMAGE FORMING METHOD

(75) Inventors: Masanobu Ninomiya, Minamiashigara (JP); Toshiyuki Yano, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 10/659,293

(22) Filed: Sep. 11, 2003

(65) Prior Publication Data

US 2004/0197693 A1 Oct. 7, 2004

(30) Foreign Application Priority Data

Mar. 24, 2003 (JP) ..... 2003-080684

(51) Int. Cl.
*G03G 9/00* (2006.01)

(52) U.S. Cl. ..... 430/108.7; 430/108.1; 430/110.3; 430/110.4; 430/137.14

(58) Field of Classification Search ..... 430/108.7, 430/108.1, 110.3, 110.4, 137.14
See application file for complete search history.

(56) References Cited

U.S. PATENT DOCUMENTS

| | | | | |
|---|---|---|---|---|
| 5,837,414 | A | 11/1998 | Kitani et al. | |
| 6,528,224 | B1 * | 3/2003 | Ohno et al. | 430/108.8 |
| 6,569,589 | B1 * | 5/2003 | Inaba et al. | 430/108.22 |

FOREIGN PATENT DOCUMENTS

| | | |
|---|---|---|
| JP | A 62-184469 | 8/1987 |
| JP | A 3-100661 | 4/1991 |
| JP | A 6-266152 | 9/1994 |
| JP | A 7-28276 | 1/1995 |
| JP | A 9-319134 | 12/1997 |
| JP | A 10-312089 | 11/1998 |
| JP | A 11-295931 | 10/1999 |
| JP | A 11-344829 | 12/1999 |

* cited by examiner

*Primary Examiner*—Mark A. Chapman
(74) *Attorney, Agent, or Firm*—Oliff & Berridge, PLC

(57) ABSTRACT

A toner for electrostatic latent image development having coloring particles containing at least a binding resin, a coloring agent and a release agent, and an external additive, wherein a variation in a number average particle diameter of the coloring particles is 25 or less, an average circularity of the coloring particles is 0.975 or more, and a variation in a circularity of the coloring particles is 2.5 or less.

19 Claims, No Drawings

TONER FOR ELECTROSTATIC LATENT IMAGE DEVELOPMENT, ELECTROSTATIC LATENT IMAGE DEVELOPER, PROCESS FOR PREPARING TONER FOR ELECTROSTATIC LATENT IMAGE DEVELOPMENT, AND IMAGE FORMING METHOD

CROSS-REFERENCE TO RELATED APPLICATIONS

This application claims priority under 35 USC 119 from Japanese Patent Application Number 2003-80684, the disclosures of which are incorporated by reference herein.

BACKGROUND OF THE INVENTION

1. Field of the Invention

The present invention relates to a toner for electrostatic latent image development used for developing an electrostatic latent image by a format such as an electrophotographic method, an electrostatic recording method or the like, a process for preparing the same, an electrostatic latent image developer, as well as an image forming method using the same.

2. Description of the Related Art

Conventionally, when an image is formed in a copying machine, a laser beam printer or the like, a Carlson method has been generally used. In conventional image forming methods in accordance with a monochrome electrophotographic method, an electrostatic latent image formed on the surface of a photosensitive member (electrostatic latent image supporting member) is developed with a toner for electrostatic latent image development (hereinafter, simply referred to as "toner" in some cases), the resulting toner image is transferred onto the surface of a recording medium, and the toner image is fixed on a recording medium with a thermal roll or the like, whereby, an image is obtained. In addition, in order to form an electrostatic latent image on the latent image supporting member again, toner remaining on the surface thereof after the aforementioned transfer is removed.

In recent years, the technological development of electrophotography has experienced rapid expansion from monochrome electrophotographic methods to full color electrophotographic methods. Color image formation in accordance with a full color electrophotographic method generally performs reproduction of all colors using four color toners including three color toners of yellow, magenta and cyan, which are three primary colors, plus a black toner.

In general full color electrophotographic methods, first, an image in a manuscript is reduced into yellow, magenta, cyan and black, and an electrostatic latent image is formed on a photoconductive layer (electrostatic latent image supporting member) for each color. Next, a toner is retained on the surface of a recording medium via a developing step and a transferring step. Then, the aforementioned steps are successively performed plural times, and toners are overlaid on the surface of the same recording medium while positions of the toners are matched. Then, a one-time fixing step provides a full color image. Overlaying of several toners having different colors in this manner is a significant difference between monochrome electrophotographic methods and full color electrophotographic methods.

In a full color image, since the image is formed by overlaying color toners of three colors or four colors, if any of these toners exhibits a property that is different from that exhibited at an earlier stage or different performance from that of other colors in a developing step, a transferring step or a fixing step, reduction in color reproducibility, deterioration of granularity, and deterioration of image quality such as color unevenness and the like are caused. Recently, high grade image quality is desired of a full color image and, if such a change in the property of a toner is caused, since it is difficult to obtain stable high image quality, it becomes more important to improve developability, transferability and fixability, and improve the stability of these properties.

Further, in recent years, in view of environmental protection, technology is moving from a non-contact charging method or a non-contact transferring method utilizing corona discharge which has conventionally been used, to a contact charging method or a contact transferring method using an electrostatic latent image supporting member abutting member. In the contact charging method or the contact transferring method, an electrically conductive elastic roller is abutted against an electrostatic latent image supporting member, and the electrostatic latent image supporting member is uniformly charged while a voltage is applied to the electrically conductive elastic roller. Then, after a toner image is formed by an exposing step (latent image forming step) and a developing step, the toner image is transferred onto the surface of an intermediate transfer material while the intermediate transfer material to which a voltage is applied is pressed to the electrostatic latent image supporting member. Further, while another electrically conductive elastic roller to which a voltage is applied is pressed to the intermediate transfer material, a recording medium such as paper or the like is passed between the intermediate transfer material and the electrically conductive elastic roller to transfer the toner image onto the recording medium, and a fixed image is obtained via a fixing step.

However, in such a transferring format, since an intermediate transferring member such as the intermediate transfer material is abutted against the electrostatic latent image supporting member during transfer, when a toner image formed on the electrostatic latent image supporting member is transferred onto the intermediate transfer material, the toner image is abutted under pressure, and partial transfer defects occur.

In addition, when transfer from the electrostatic latent image supporting member to the intermediate transfer material is not complete, and toner remains on the surface of the electrostatic latent image supporting member, the remaining toner passes through a nip between the electrically conductive elastic roller and the electrostatic latent image supporting member abutted thereagainst. And, when the remaining toner is present between the electrostatic image supporting member and the electrically conductive elastic roller, uniform charging can not be realized on the surface of the electrostatic latent image supporting member, an electrostatic latent image of the electrostatic latent image supporting member is disturbed, and image defects are caused.

In response to demand for higher image quality in the aforementioned full color images, a diameter of toner has become smaller and, accordingly, since a force adhering the toner to the electrostatic latent image supporting member becomes greater in the transferring step as compared with a Coulomb's force applied to the toner and, as a result, the toner remaining after transfer (remaining toner) is increased, and there has been a tendency for charging defects of the electrostatic latent image supporting member to be accelerated.

For the purpose of preventing these charging defects of the electrostatic latent image supporting member, cleaning means is disposed between a contact point between the electrostatic latent image supporting member and the intermediate transfer material, and a contact point between the electrostatic latent image supporting member and the electrically conductive elastic roller. The toner is abutted by pressure when it passes between the electrostatic latent image supporting member and the intermediate transfer material and, as a result, the remaining toner is strongly adhered to the surface of the electrostatic latent image supporting member.

As a cleaning method of removing the aforementioned adhered remaining toner from the electrostatic latent image supporting member, a blade cleaning method of strongly pressing an elastic blade against the electrostatic latent image supporting member to remove the toner is considered to be suitable from the viewpoint of the cleaning ability, and is generally used. However, in this system, since not only the electrically conductive elastic roller and the intermediate transfer material but also the elastic blade are strongly pressed against the electrostatic latent image supporting member, abrasion resulting from deterioration in the surface of the electrostatic latent image supporting member easily occurs, and there is a problem with respect to extending a life of the electrostatic latent image supporting member.

On the other hand, a method of cleaning the electrostatic latent image supporting member by pressing a brush instead of the aforementioned elastic blade against the electrostatic latent image supporting member using weak pressure has also been proposed. Although the cleaning method using the brush is effective in suppressing deterioration in the surface of the electrostatic latent image supporting member, since an amount of a captured toner is small as compared with the elastic blade, there is a problem in that, when the transfer efficiency is low, it is difficult to apply the method, and a force capturing the adhered remaining toner is weaker as compared with the elastic blade.

In addition, when a step of transferring from the electrostatic latent image supporting member to the intermediate transfer material is made a primary transfer, and a step of transferring from the intermediate transfer material to the recording medium is made a secondary transfer, in full color image formation, the two transfers are repeated, and a technique for improving the transfer efficiency becomes more and more important. In particular, in the aforementioned secondary transfer, since multiple color toner images are transferred once, and a recording medium is variously changed (for example, in the case of paper, a thickness thereof, surface properties, etc.), it is necessary to control the transferability so as to be extremely high in order to reduce the influence of these variations. However, when change in a microstructure of the toner surface, in particular, embedding or peeling of an external additive, is caused by the influence of stress received upon the aforementioned primary transfer, a disadvantage of reduction in transferability in the secondary transfer is confirmed.

For the above reasons, a toner used in such an image forming method is required to have high transfer efficiency, have maintenance of a toner structure relative to stress, and allow easy removal of remaining toner in brush cleaning.

As a means for improving the transfer efficiency of a toner, it has been proposed that a toner shape be made to approach a sphere (for example, see Japanese Patent Application Laid-Open (JP-A) No. 62-184469). In addition, it has been proposed that cleanability with a cleaning blade is improved by defining an average particle diameter, an average circularity and an odd-shaped circularity content of a spherical toner, and a developer has been proposed for which the transfer efficiency has been comprehensively taken into consideration, by defining a toner particle size and particle size distribution, and an average circularity and circularity distribution of a toner (for example, see JP-A Nos. 11-344829 and 11-295931).

In these proposals, although the transfer efficiency is improved by making a toner shape and shape distribution approach a spherical shape, flowability of a developer is enhanced, and at the same time, a coagulated bulk density is increased by sphericalizing the toner. As a result, there arises a phenomenon in which an amount of the toner to be conveyed in a developing device becomes unstable. Although an amount of the toner to be conveyed can be improved by controlling the roughness of the surface of a magnet roll and narrowing a distance between a conveyance amount controlling material and the magnet roll, a bulk density of the toner is increased more and more and, accordingly, stress applied to the toner is strengthened, and maintenance of a toner structure in response to this stress conversely becomes weak.

In addition, in order to improve the cleanability of a spherical toner, use of two kinds of inorganic minute particles having different particle diameters including particles having an average particle diameter of not smaller than 5 mμ, and smaller than 20 mμ, and particles having an average particle diameter of not smaller than 20 mμ and smaller than 40 mμ, and addition thereof, as an external additive, in a specified amount to a toner are disclosed (for example, see JP-A No. 3-100661). By this method, high developability, transferability and cleanability can be obtained at an early stage. However, since a force applied to the toner in a developing device can not be decreased with time, embedding or peeling of the external additive easily occurs, and developability and transferability are greatly changed from those at an early stage.

On the other hand, it is disclosed that, in order to suppress embedding of an external additive into a toner against such stress, it is effective to use inorganic minute particles having a large particle diameter as the external additive (for example, see JP-A Nos. 7-28276, 9-319134 and 10-312089). However, in each of these cases, since the inorganic minute particles have a great true specific gravity, when external additive particles are made to be large, peeling of the external additive can not be avoided due to stirring stress in a developing device. In addition, since an inorganic minute particle does not exhibit a completely spherical shape, when adhered to the toner surface, it is difficult to control budding of the external additive so as to be uniform. Therefore, this causes variation in microscopic concave shapes on the surface which function as spacers, and since stress is selectively applied to the concave parts, embedding or peeling of the external additive is further accelerated.

In addition, a technique is disclosed in which, in order to effectively manifest the spacer function, spherical organic resin minute particles having a particle diameter in the range of 50 to 200 nm are added to a toner (see JP-A No. 6-266152). By using the aforementioned spherical organic resin minute particles, it is possible to effectively manifest the spacer function at an early stage. However, although the spherical organic resin minute particles undergo little embedding and peeling due to stress over time, since the spherical organic resin minute particles themselves are deformed, it is difficult to stably manifest the high spacer function.

SUMMARY OF THE INVENTION

The present invention aims to solve the aforementioned conventional problems and attain the following objects. That is, an object of the invention is to provide a toner for electrostatic latent image development which can maintain high toner transferability over a long time and, in particular, can improve generated defects even in an image forming process in which toner remaining on the surface of an electrostatic latent image supporting member is recovered using an electrostatic brush without a blade cleaning step which promotes abrasion of an electrostatic latent image supporting member, a process for preparing the toner for electrostatic latent image development, and an electrostatic latent image developer using the toner for electrostatic latent image development. Also, an object of the invention is to provide an image forming method that can perform developing, transfer and fixation in response to high image quality demands.

The present inventors have conducted intensive research and, as a result, found that the above problems can be overcome by controlling a particle diameter, a particle size distribution, an average circularity, and a circularity distribution of a toner, and by using a particular kind of an external additive having a particular size, which resulted in completion of the invention. That is, the invention is as follows.

An aspect of the invention is to provide a toner for electrostatic latent image development comprising: coloring particles containing at least a binding resin, a colorant and a release agent; and an external additive, wherein a variation in a number average particle diameter of the coloring particles is 25 or less, an average circularity of the coloring particles is 0.975 or more, and a variation in a circularity of the coloring particles is 2.5 or less.

Another aspect of the invention is to provide a process for preparing a toner for electrostatic latent image development, which comprises: mixing a resin minute particle dispersion, a colorant particle dispersion and a release agent particle dispersion, and aggregating the resin minute particles, the colorant particles and the release agent particles to form aggregated particles; and heating the aggregated particles to a temperature not lower than a glass transition temperature of the resin minute particles to fuse and coalesce the particles.

Still another aspect of the invention is to provide an electrostatic latent image developer comprising a toner for electrostatic latent image development and a carrier, the toner for electrostatic latent image development comprising: coloring particles containing at least a binding resin, a colorant and a release agent; and an external additive, wherein a variation in a number average particle diameter of the coloring particles is 25 or less, an average circularity of the coloring particles is 0.975 or more, and a variation in a circularity of the coloring particles is 2.5 or less.

Still another aspect of the invention is to provide an image forming method comprising a charging step of charging a surface of an electrostatic latent image supporting member, an electrostatic latent image forming step of forming an electrostatic latent image on the surface of the electrostatic latent image supporting member, a developing step of developing the electrostatic latent image using an electrostatic latent image developer to form a toner image, a transferring step of transferring the toner image formed on the surface of the electrostatic latent image supporting member onto a surface of a transfer receiving material, and a cleaning step of removing toner remaining on the surface of the electrostatic latent image supporting member, wherein: the cleaning step is a step of removing remaining toner using an electrostatic brush; the electrostatic latent image developer comprises a toner for electrostatic latent image development and a carrier; the toner for electrostatic latent image development has coloring particles containing at least a binding resin, a colorant and a release agent, and an external additive; a variation in a number average particle diameter of the coloring particles is 2.5 or less; an average circularity of the coloring particles is 0.975 or more; and a variation of a circularity of the coloring particles is 2.5 or less.

DETAILED DESCRIPTION OF THE INVENTION

The present invention will be explained in detail below.

<Toner for Electrostatic Latent Image Development and Process for Preparing the Same>

The toner for electrostatic latent image development of the invention is a toner for electrostatic latent image development having at least coloring particles containing a binding resin, a colorant and a release agent, and an external additive, wherein a variation of a number average particle diameter of the coloring particles is 25 or less, an average circularity of the particles is 0.975 or more, and a variation of a circularity of the particles is 2.5 or more.

By making a particle diameter distribution of the toner a sharp distribution and suppressing a variation of charge due to a difference in particle diameters of the toner, transfer efficiency can be improved. In addition, by increasing a circularity of the toner and making its shape distribution a sharp distribution, a variation of an amount of the external additive to be adhered to the toner surface and the adhesion state can be suppressed. As a result, manifestation of uniform charge of the toner and a uniform spacer effect of an external additive is realized, and it becomes possible to achieve the high transfer efficiency.

The toner for electrostatic latent image development of the invention has at least the coloring particles containing the binding resin, the colorant and the release agent, and the external additive and, further, if necessary, other components. These will be described later.

A number average particle diameter $D_{TN}$ of the coloring particles in the invention is preferably in the range of 5.0 to 7.0 μm, and more preferably in the range of 5.5 to 6.5 μm. When the number average particle diameter $D_{TN}$ is smaller than 5.0 μm, a surface area of the coloring particles becomes large, an electrostatic adhering force is increased, and the transfer efficiency is extremely reduced in some cases. In addition, when the number average particle diameter $D_{TN}$ is greater than 7.0 μm, since toner flight in a developing step and a transferring step becomes remarkable, the reproducibility of an electrostatic latent image is reduced, and it becomes difficult to obtain high grade image quality in some cases.

The aforementioned range of the number average particle diameter is preferable in that the color reproducibility is excellent in formation of a full color image.

In addition, it is required that the variation of the number average particle diameter of the coloring particles in the invention is 25 or less, and it is preferably 20 or less. When the variation of the number average particle diameter is large, a difference in size between small diameter coloring particles and large diameter coloring particles becomes large. Due to this difference in size, a difference in surface area between individual coloring particles becomes large.

Since a surface charge density of toner in a developing device corresponds to the aforementioned surface area, a difference in surface area between the individual coloring particles is manifested as a difference in charge amount between the individual coloring particles.

Therefore, when the variation of the number average particle diameter becomes greater than 25, the difference in charge amount between the individual coloring particles becomes large. And, since an optimal transfer electric field for each coloring particle varies due to this difference in charge amount, it becomes difficult to transfer coloring particles having different charge amounts at the same time under one transferring condition and at a very high efficiency.

The aforementioned variation of the number average particle diameter refers to a standard variance expressed as a percentage relative to an average obtained by statistically processing measured values of the number average particle diameter $D_{TN}$ measured for a certain number of coloring particles. A specific measuring method will be described later.

It is required that the average circularity of the coloring particles in the invention is 0.975 or more, and it is preferably 0.980 or more. In addition, it is required that the variation of the circularity of the coloring particles is 0.25 or less, and it is preferably 0.20 or less.

When the aforementioned average circularity is 1.0, a particle is a true sphere. As the numerical value becomes smaller, an odd-shaped degree of the particle becomes greater. When the average circularity is smaller than 0.975, the odd-shaped degree of the coloring particle becomes greater, and a surface area becomes greater. When the surface area becomes greater, an electrostatic adhering force is increased, and transfer efficiency is extremely reduced. In addition, when the odd-shaped degree is great, the external additive is embedded into convex parts of the surface of the coloring particle, and the function (charge applying and spacer effect) of the external additive is substantially reduced. Due to these influences, it becomes difficult to achieve high transfer efficiency.

In addition, when the aforementioned variation of the circularity is larger than 0.25, since a distribution of a shape of coloring particles becomes great, the state of external additive adhesion per coloring particle becomes non-uniform. Since a variation of this state of external additive adhesion leads to a variation of an charge amount, it becomes difficult to transfer coloring particles having different charge amounts at the same time under one transferring condition and at a very high efficiency.

As used herein, the average circularity refers to a value obtained by performing image analysis for a certain number of coloring particles, obtaining circularities of respective photographed coloring particles according to the following equation, and averaging them. In addition, the variation of the circularity is as follows. The thus obtained respective circularities are statistically processed, and a standard variance relative to an average is expressed as a percentage.

$$\text{Circularity}=\text{circle-equivalent diameter circumferential length/circumferential length}=2A^{1/2}\pi/PM$$

(In the above equation, A represents a projected area of a particle, and PM represents a circumferential length of a particle.)

The number average particle diameter, the variation of the number average particle diameter, the average circularity, and the variation of the circularity of the coloring particles were obtained by performing image analysis and statistical processing on at least 5000 coloring particles using a flowing particle image analyzing apparatus FPIA-2100 (manufactured by Sysmex Corporation).

Next, a process for preparing the coloring particles in the invention will be described.

The coloring particles in the invention can be prepared by a kneading and grinding process, or by a chemical process such as emulsion polymerization or suspension polymerization which are known. In the invention, it is preferable to prepare the toner by an emulsion polymerization method in that a toner excellent in particle size distribution and shape distribution can be prepared, and from the viewpoint of yield and environmental load. Herein, a process for preparing a toner when an emulsion polymerization method is used will be explained in detail.

In the emulsion polymerization method, a resin dispersion in which a resin is dispersed in an ionic surfactant (resin minute particle dispersion) and a pigment dispersion in which a pigment is dispersed in an ionic surfactant having an opposite polarity (colorant dispersion) are mixed, a heterogeneous aggregation is generated to form aggregated particles having a toner diameter (aggregation step) and, thereafter, the aggregated particles are fused and coalesced by heating to a glass transition temperature of the resin or higher (fusing step), washed and dried, whereby, the coloring particles are prepared.

In this method, it is possible to control a toner shape from undefined to spherical by selecting a heating temperature condition or the like. In addition, even when the polarity of the pigment and that of the resin particles are the same, similar aggregated particles can be produced by adding a surfactant having the opposite polarity. Further, the aforementioned aggregated particle dispersion is heated and, before the aggregated particles are coalesced, another minute particle dispersion is added and mixed, to adhere the minute particles to the surfaces of the original aggregated particles, and this is coalesced by heating to the glass transition temperature of the resin or higher, whereby, a layered structure from the surface to the interior of a toner can be controlled. Further, according to this method, it also becomes possible to cover the toner surface with a resin, to cover the toner surface with a charge control agent, or to dispose a wax (release agent) or a pigment in the vicinity of the toner surface.

Thereupon, an important factor for controlling a particle size distribution and a shape distribution, is that the minute particles (adhering particles) of the minute particle dispersion which is to be added and mixed later is adhered to the surfaces of the aggregated particles uniformly and firmly. When minute particles that should be adhered are present in a free state, or when once adhered minute particles are freed again, the particle size distribution and the shape distribution of the toner are easily widened. When the particle size distribution is widened, fine powder is increased and, at developing, this fine powder is strongly adhered to a photosensitive member, causing a black point. In a two-component developer, this fine powder easily leads to carrier pollution, and shortens a life of the developer. In addition, in a one-component developer, this fine powder is adhered to and pollutes a developing roll, a charging roll, a trimming roll or a blade, causing deterioration in image quality. Further, a great factor concerning reduction in image quality and reliance is the problem of the particle diameter distribution in the toner.

In addition, when the toner is prepared by the aforementioned emulsion polymerization method, control of stirring conditions is important to the particle diameter distribution and the shape distribution. Since a viscosity of a dispersion is increased at formation of aggregated particles which are to be a matrix or after addition of adhering particles, when the dispersion is stirred at a high shear rate using a stirring wing such as a slant paddle type for the purpose of uniformly mixing the dispersion, adhesion of aggregated particles to a wall of a reaction vessel or the stirring wing is increased, and therefore, uniformization of the particle diameter is inhibited. In order to perform uniform stirring at a low shear rate, it is effective to use a stirring wing of a wing shape (plate wing) that is wide in a direction of a dispersion depth.

Further, it is also effective to remove crude powder by filtering the dispersion using a filter bag having an opening of 10 μm after formation of the aggregated particles and, if necessary, it is also effective to perform multi-stage or repetitive treatment. The influence of the particle diameter distribution or the shape distribution on image quality becomes great when the average particle diameter of the toner is small or as a toner shape approaches a spherical shape.

Usually, since this aggregating and coalescing process performs mixing and aggregating at once, aggregated particles can be fused in a uniform mixed state, and the toner composition becomes uniform from the surface to the interior. When a release agent is contained according to the aforementioned method, the release agent is also present on the surface after coalescing, and phenomena such as occurrence of filming, embedding of an external additive for imparting flowability in the interior of the toner, and the like are easily caused.

Then, in the aggregation step, a balance of amounts of ionic surfactants having the respective polarities in a dispersion is shifted in advance at an early stage, and first stage matrix aggregated particles are formed and stabilized at a glass transition temperature or lower. Thereafter, at a second stage, a minute particle dispersion treated with a surfactant having a polarity and an amount such that the shift of the balance is compensated for is added. Further, if necessary, the material is slightly heated and stabilized at a glass transition temperature of the resin contained in the aforementioned matrix aggregated particles or in the additional minute particles or lower and, thereafter, the material is heated to the glass transition temperature or higher, whereby, coalescence is possible while the minute particles added at the second stage are adhered to the surfaces of the matrix aggregating particles. Moreover, these aggregating procedures can also be performed by step-wise repetition over plural times, and, as a result, the composition and the physical property can be changed step-wise from the surface to the interior of the toner particles, making it extremely easy to control a toner structure.

For example, in the case of color toner used in multi-color developing, matrix aggregated particles are produced from resin minute particles and pigment minute particles at a first stage, and thereafter, another resin minute particle dispersion is added to form only a resin layer on the toner surface, whereby, influence on charging behavior due to the pigment minute particle can be minimized. As a result, variation in charging properties depending on a kind of pigment can be suppressed. In addition, when a glass transition temperature of resin minute particles to be added at a second stage is set at a higher temperature, a toner can be covered in a capsule-manner, and both of heat retainability and fixability can be satisfied.

Further, when a dispersion of minute particles of a release agent such as a wax is added at a second stage and, further, a shell is formed on a top surface using a dispersion of a resin having high hardness at a third stage, exposure of the wax on the toner surface can be suppressed, and it is also possible to make the wax effectively serve as a release agent at fixation.

Alternatively, exposure of the wax may be prevented by forming a shell on a top surface at a second stage after inclusion of the release agent minute particles in the matrix aggregated particles. When exposure of the wax is prevented, not only filming onto a photosensitive member or the like is suppressed, but also powder flowability of the toner can be improved.

In the method of step-wisely adhering minute particles to the surfaces of aggregated particles and heating to fuse in this manner, variation of the maintenance of the particle size distribution and the shape distribution, and variation of the average particle diameter and the circularity can be suppressed. In addition, addition of a stabilizer such as a surfactant, a base and an acid for enhancing the stability of the aggregated particles becomes unnecessary, or an amount of these to be added can be suppressed to a minimum.

It is desirable that a dispersion diameter of dispersed minute particles is 1 μm or less when used for the matrix aggregated particles and when used as additional minute particles. When the diameter exceeds 1 μm, the particle size distribution of the finally produced toner is widened, and free minute particles are generated, causing reduction in performance of the toner or reduction in reliance.

An amount of the additional minute particle dispersion depends on a volume fraction of contained matrix aggregated particles, and it is desirable that an amount of additional minute particles is adjusted to less than 50% (in terms of volume) of the finally produced aggregated particles. When an amount of the additional minute particles exceeds 50%, since the minute particles are not adhered to the matrix aggregated particles and new aggregated particles are produced, the distribution of the composition and the distribution of the particle diameter are remarkably widened, and desired performance can not be obtained.

In addition, it is effective to divide addition of a minute particle dispersion and perform the addition step-wise or gradually and continuously, in order to suppress occurrence of new fine aggregated particles and make the particle size distribution and the shape distribution sharp. Further, generation of free minute particles can be suppressed by heating the aggregated particle dispersion to a temperature of a glass transition temperature of resin in the matrix aggregated particles and in the additional minute particles or lower, and preferably to a temperature in the range from a temperature of 40° C. lower than the glass transition temperature to the glass transition temperature, when the minute particle dispersion is added.

Examples of a thermoplastic binding resin used as the binding resin in the toner of the invention include polymers of monomers including styrenes such as styrene, parachlorostyrene, α-methylstyrene and the like; esters having a vinyl group such as methyl acrylate, ethyl acrylate, n-propyl acrylate, lauryl acrylate, 2-ethylhexyl acrylate, methyl methacrylate, ethyl methacrylate, n-propyl methacrylate, lauryl methacrylate, 2-ethylhexyl methacrylate and the like; vinylnitriles such as acrylonitrile, methacrylonitrile and the like; vinyl ethers such as vinyl methyl ether, vinyl isobutyl ether and the like; vinyl ketones such as vinyl methyl ketone, vinyl ethyl ketone, vinyl isopropenyl ketone and the like; polyolefins such as ethylene, propylene and butadiene; as well as, copolymers in which two or more of these are combined, and mixtures thereof, and further, non-vinyl fused type resins such as epoxy resin, polyester resin, polyurethane resin, polyamide resin, cellulose resin, polyether resin and the like, mixtures of these and the aforementioned vinyl type resins, and graft polymers obtained by polymerizing a vinyl type monomer under the presence of these. These resins may be used alone, or two or more kinds of them may be used jointly.

Among these, when a vinyl type monomer is used, a resin minute particle dispersion can be prepared by performing emulsion polymerization or seed polymerization using an ionic surfactant, and when other resins are used, a desired resin minute particle dispersion can be prepared by dissolving a resin in a solvent which is oily and has relatively low solubility in water, dispersing minute particles in water using a dispersing machine such as a homogenizer in the presence of an ionic surfactant and a polymer electrolyte in water and, thereafter, heating or evacuating to volatilize the solvent.

The aforementioned thermoplastic binding resin can be stably prepared as minute particles by emulsion polymerization by incorporating a dissociable vinyl type monomer into the aforementioned monomer. As an example of the dissociable vinyl type monomer, any monomers that are a raw material of a polymer acid or a polymer base such as acrylic acid, methacrylic acid, maleic acid, cinnamic acid, fumaric acid, vinylsulfonic acid, ethyleneimine, vinylpyridine and vinylamine can be used. From the standpoint of an easy polymer-forming reaction, a polymer acid is suitable, and further, a dissociable vinyl type monomer having a carboxyl group such as acrylic acid, methacrylic acid, maleic acid, cinnamic acid, and fumaric acid is particularly effective in order to control a polymerization degree and control a glass transition temperature.

An average particle diameter of the resin minute particles is preferably 1 μm or less, and more preferably in the range of 0.01 to 1 μm. When the average particle diameter of the resin minute particles exceeds 1 μm, the particle size distribution and the shape distribution of the finally obtained toners for electrostatic latent image development are widened, and free particles are generated, causing unbalance in the composition of the toner, and leading to reduction in performance and reliance. On the other hand, when the average particle diameter of the resin particles is in the aforementioned range, the aforementioned defects do not occur and moreover, unbalance between toners is decreased, dispersion of a pigment or the like in a toner becomes better, and variation in performance and reliance becomes small, which is advantageous. The average particle diameter of the resin minute particles can be measured, for example, using a microtrack or the like.

As the release agent in the invention, low-molecular polyolefins such as polyethylene, polypropylene, polybutene and the like; silicones having a softening point by heating; fatty acid amides such as oleic acid amide, erucic acid amide, ricinoleic acid amide, stearic acid amide and the like; vegetable waxes such as ester wax, carnauba wax, rice wax, candelilla wax, Japan wax, jojoba oil and the like; animal waxes such as beewax; mineral/petroleum waxes such as montan wax, ozokerite, ceresin, paraffin wax, microcrystalline wax, Fischer Tropsch wax and the like; and modifications thereof can be used. These waxes can be prepared into a dispersion of particles of 1 μm or less by dispersing them together with an ionic surfactant, or a polymer electrolyte such as a polymer acid or a polymer base in water, heating to a melting point or higher and, at the same time, finely-dividing them with a homogenizer or a pressure discharging-type dispersing machine which can apply strong shear.

An average particle diameter of the release agent particles is preferably 1 μm or less, and more preferably in the range of 0.01 to 1 μm. When the average particle diameter exceeds 1 μm, the particle size distribution and the shape distribution of the finally obtained toners for electrostatic latent image development are widened, free particles are generated to cause unbalance in the composition of a toner, leading to reduction in performance and reliance. On the other hand, when the average particle diameter of the release agent particles is in the aforementioned range, the aforementioned defects do not occur, unbalance between toners is decreased, a dispersion in the toner becomes better, and variation in performance and reliance becomes small, which is advantageous. The aforementioned average particle diameter can be measured, for example, using a microtrack or the like.

As the colorant in the invention, one kind of various pigments such as carbon black, chromium yellow, HANSA yellow, benzidine yellow, threne yellow, quinoline yellow, permanent orange GTR, pyrazolone orange, Vulcan orange, watchang red, permanent red, brilliant carmine 3B, brilliant carmine 6B, DUPONT oil red, pyrazolone red, risol red, rhodamine B rake, lake red C, rose Bengal, aniline blue, ultra marine blue, chalcoil blue, methylene blue chloride, phthalocyanine blue, phthalocyanine green and malachite green oxalate, or various dyes such as those of acridine type, xanthene type, azo type, benzoquinone type, azine type, anthraquinone type, thioindigo type, dioxazine type, thiazine type, azomethine type, indigo type, phthalocyanine type, aniline black type, polymethine type, triphenylmethane type, diphenylmethane type and thiazole type can be used, or two or more kinds of these can be mixed and used.

An average particle diameter of the colorant particles in the invention is preferably 0.8 μm or less, and more preferably in the range of 0.05 to 0.5 μm. When the average particle diameter of the colorant particles exceeds 0.8 μm, the particle size distribution and the shape distribution of the finally obtained toner for electrostatic latent image development are widened, and free particles are generated, causing unbalance of the toner composition, and leading to reduction in performance and reliance. When the average particle diameter of the colorant particles is smaller than 0.05 μm, not only the coloring property of the toner is reduced, but also shape controllability, which is one of the characteristics of an emulsion aggregating method, is deteriorated, and toner having a shape near a true sphere can not be obtained.

In addition, if necessary, a charge control agent can be used. As the charge control agent, various charge control agents which are normally used, such as a dye comprising a quaternary ammonium salt, a nigrosin type compound, and a complex of aluminum, iron or chromium, or a triphenylmethane type pigment can be employed. Among them, from the standpoints of control of ionic strength which influences the stability at the time of aggregating or fusing and coalescing, and reduction in waste water pollution, a charge control agent which is hardly soluble in water is suitably used.

Examples of a surfactant which is used in emulsion polymerization, seed polymerization, pigment dispersion, resin particle dispersion, release agent dispersion, aggregation or in stabilization thereof include anionic surfactants such as those of sulfate ester salt type, sulfonate salt type, phosphate ester type, soap type and the like; and cationic surfactants such as those of amine salt type, quaternary ammonium salt type and the like. In addition, it is also effective to jointly use nonionic surfactants such as those of polyethylene glycol type, alkylphenol ethylene oxide adduct type, polyhydric alcohol type and the like. As the dispersing means, general dispersing machines such as a rotation shearing-type homogenizer, a ball mill, a sand mill and a DYNO mill having media can be used.

In addition, when a complex composed of a resin and a pigment is used, a method of obtaining the complex by dissolving and dispersing the resin and the pigment into a solvent, dispersing them together with the aforementioned suitable dispersing agent in water, and removing the solvent by heating and evacuating, or a method of preparing the complex by mechanically shearing or electrically adsorbing or immobilizing them onto the surface of a latex prepared by emulsion polymerization or seed polymerization can be adopted. These methods are effective for suppressing release of the pigment as additional particles, and improving dependency of chargeability on the pigment.

Examples of a dispersing medium in a dispersion in which the aforementioned resin minute particle dispersion, colorant dispersion, release agent dispersion and the like are dispersed include an aqueous medium.

Examples of the aqueous medium include water such as distilled water, ion-exchanged water and the like, and alcohols. These may be used alone, or two or more of them may be used jointly.

In the invention, a dispersion in which particles containing at least resin minute particles are dispersed can be prepared by adding and mixing the aforementioned resin minute particle dispersion, colorant dispersion and release agent dispersion, and the resin particles, the colorant and the release agent are aggregated to form aggregated particles by heating within the range from room temperature to a glass transition temperature of the resin. It is preferable that a number average particle diameter of the aggregated particles is in the range of 3 to 10 μm.

It is sufficient that a content of the resin minute particles, when the resin minute particle dispersion and the colorant dispersion and the like are mixed, is 40% by mass or less, and the content thereof is preferably in the range of around 2 to 20% by mass. In addition, it is sufficient that a content of the colorant is 50% by mass or less, and the content thereof is preferably in the range of around 2 to 40% by mass. Further, it is sufficient that a content of other components (particles) is such that the objects of the invention are not inhibited, and the content thereof is generally extremely small. Specifically, the content of the other components is in the range of around 0.01 to 5% by mass, and preferably in the range of around 0.5 to 2% by mass.

Then, after undergoing the aforementioned adhering step as necessary, a mixture containing the aggregated particles is heat-treated at a temperature of not less than a softening point of a resin, and generally in the range of 70 to 120° C., to fuse the aggregated particles, whereby, a coloring particle-containing solution can be obtained.

In the obtained coloring particle dispersion, coloring particles are separated by centrifugation or suction filtration, and washed with ion-exchanged water one to three times. Thereafter, the coloring particles are filtered, washed with ion-exchanged water one to three times, and dried, whereby, the coloring particles used in the invention can be obtained.

Next, an external additive used in the invention will be described.

The coloring particles in the invention become the toner for electrostatic latent image development by having an external additive dispersed on the surface thereof. It is preferable to use as the external additive monodisperse spherical particles having a true specific gravity in the range of 1.0 to 1.9. The true specific gravity is more preferably in the range of 1.0 to 1.3. By using such an external additive, stress applied to a toner can be relaxed, and high transfer efficiency can be maintained.

That is, by controlling the true specific gravity to be 1.9 or less, peeling of the monodisperse spherical particles from the coloring particles can be suppressed. In addition, by controlling the true specific gravity to be 1.0 or more, aggregation and dispersion of the monodisperse spherical particles on the surfaces of the coloring particles can be suppressed.

A ratio of the number average particle diameter $D_{TN}$ of the coloring particles and a number average particle diameter $D_{add}$ of the aforementioned monodisperse spherical particles ($D_{TN}/D_{add}$) is preferably in the range of $25 \leqq D_{TN}/D_{add} \leqq 80$, more preferably in the range of $40 \leqq D_{TN}/D_{add} \leqq 70$, and even more preferably in the range of $50 \leqq D_{TN}/D_{add} \leqq 60$. In this manner, a contact area between the toner and an electrostatic latent image supporting member or an intermediate transfer material can be decreased (spacer effect), an electrostatic adhering force can be reduced, and transfer efficiency can be further enhanced.

The aforementioned $D_{TN}/D_{add}$ is a ratio of a particle diameter of the monodisperse spherical particles and that of the coloring particles, and is an index of the spacer effect. When $D_{TN}/D_{add}$ is smaller than 25, the size of the external additive becomes relatively larger as compared with the size of the coloring particles, the monodisperse spherical particles tend to detach from the coloring particles, and non-electrostatic adhering force reduction cannot be efficiently achieved. In addition, the monodisperse spherical particles tend to move to a contact member, and secondary disorders such as charge inhibition, image quality defects and the like are easily caused.

In addition, when $D_{TN}/D_{add}$ is larger than 80, the monodisperse spherical particles tend to not work effectively for reducing a non-electrostatic adhering force. Further, due to stress in a developing device, the monodisperse spherical particles tend to be embedded in the coloring particles, and the developability and transferability improving effect tends to be remarkably reduced.

And, by using a combination of the aforementioned definition of the range of $D_{TN}/D_{add}$ and the aforementioned definition of the specific gravity of the external additive, the spacer effect and stress relaxability are imparted, and suitability to a cleaning process using an electrostatic brush as described later is considerably improved.

In addition, by using a combination of these with spherical coloring particles having a sharper particle diameter distribution in which the aforementioned variation of the number average particle diameter is 25 or less, and a sharper shape distribution in which the average circularity is 0.975 or more, and the variation of the circularity is 2.5 or less, it becomes possible to obtain even higher transfer efficiency and maintain the transfer efficiency. In particular, in this case, the transfer efficiency can be maintained over a long period of time even when a contact-type charging member and transferring member described later are used.

Since the monodisperse spherical minute particles are monodisperse and spherical, the minute particles are uniformly dispersed on the surface of a coloring particle, and a stable spacer effect can be obtained. As the definition of monodispersity in the invention, discussion can be made using a standard variance of an average particle diameter, including an aggregated material. It is preferable that the standard variance is the number average particle diameter $D_{add} \times 0.22$ or less. As the definition of "spherical" in the invention, discussion can be made using a circularity of Wadell. The circularity is preferably 0.6 or more, and more preferably 0.8 or more.

Examples of other representative inorganic minute particles used as a general external additive include titanium oxide (true specific gravity 4.2, refractive index 2.6), alumina (true specific gravity 4.0, refractive index 1.8), and zinc oxide (specific gravity 5.6, refractive index 2.0). However, each of these has a high true specific gravity and, when the inorganic minute particles are made to be larger than a particle diameter effectively manifesting the spacer effect, peeling from the coloring particles is easily caused, peeled particles of the external additive are easily moved to a charge imparting member, or an electrostatic latent image supporting member, causing reduction in charging or image quality defects.

In the invention, a monodisperse spherical silica can be preferably used as the external additive.

The monodisperse spherical silica in the invention can be obtained by a sol-gel method, which is a wet process. Reasons that the external additive is limited to silica are that, for example, a refractive index thereof is around 1.5 and, even when a particle diameter grows large, it does not influence reduction in the transparency due to light scattering, and in particular, light transmittance at formation of an image on OHP sheet.

A true specific gravity of the monodisperse spherical silica can be controlled to be lower as compared with that of silica prepared by a vapor phase oxidizing method because the silica is prepared by a wet process without firing. In addition, the true specific gravity can be further adjusted by controlling a kind of hydrophobicization-treating agent or a treating amount in hydrophobicizing treatment. A particle diameter can be freely controlled by hydrolysis of the sol-gel method, a weight ratio of alkoxysilane, ammonia, alcohol and water, a reaction temperature, a stirring rate and a supplying rate in a polycondensing step. Monodispersity and spherical shape can be attained by preparation by the present procedure.

Specifically, tetramethoxysilane is added dropwise using aqueous ammonia as a catalyst in the presence of an alcohol while heating is carried out, followed by stirring. Then, the silica sol suspension obtained by the reaction is centrifuged, so as to be separated into wet silica gel, alcohol and aqueous ammonia. A solvent is added to the wet silica gel to again obtain a silica sol state, and a hydrophobicization treating agent is added to hydrophobicize the silica surface. As the hydrophobicization treating agent, a general silane compound can be used. Then, the solvent is removed from this hydrophobicization-treated silica sol, and this can be dried and sieved to obtain desired monodisperse spherical silica. Alternatively, the thus obtained silica may be treated again. A process for preparing monodisperse spherical silica in the invention is not limited to the aforementioned process.

As the silane compound, a water-soluble silane compound can be used. As such a silane compound, a compound represented by the chemical structural formula $R_aSiX_{4-a}$ (wherein a is an integer of 0 to 3, R represents a hydrogen atom, or an organic group such as an alkyl group and an alkenyl group, and X represents a hydrolyzable group such as a chlorine atom, a methoxy group and an ethoxy group) can be used, and any type of chlorosilane, alkoxysilane, silazane and a special silylating agent may be used.

Specifically, representative examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane. Particularly preferable examples of the hydrophobicizing treating agent include dimethyldimethoxysilane, hexamethyldisilazane, methyltrimethoxysilane, isobutyltrimethoxysilane, decyltrimethoxysilane and the like.

An amount of the monodisperse spherical silica to be added is preferably in the range of 0.5 to 5 parts by mass, and more preferably in the range of 1 to 3 parts by mass, relative to 100 parts by mass of the coloring particles. When the added amount is smaller than 0.5 parts by mass, the non-electrostatic adhering force decreasing effect is small, and the developability and transferability improving effect is not sufficiently obtained in some cases. On the other hand, when the added amount is larger than 5 parts by mass, the mass exceeds an amount that can cover the surface of a coloring particle as one layer, coverage becomes excessive, silica moves to a contact member, and secondary disorders are easily caused.

In addition, in the invention, as the external additive, at least monodisperse spherical organic resin minute particles are used, and it is preferable that a gel fraction of the monodisperse spherical organic resin minute particles is 70% by mass or more.

This monodisperse spherical organic resin minute particle external additive will be explained below.

In the invention, in order to obtain a necessary hardness which an external additive is required to have, a gel fraction of the monodisperse spherical organic resin minute particles is preferably 70% by mass or more, and more preferably 80% by mass or more. As used herein, a gel fraction is a ratio by mass of insolubles in an organic solvent (tetrahydrofuran), and can be obtained by the following equation.

$$\text{Gel fraction (\% by mass)} = (\text{mass of insolubles in organic solvent/mass of sample}) \times 100$$

The gel fraction is correlated with a cross-linking degree and a hardness of a resin. In the case where the gel fraction is smaller than 70% by mass, when a toner with the resin added thereto and a carrier are mixed at a predetermined ratio to obtain an electrostatic latent image developer (hereinafter, simply referred to as "developer" in some cases), and the developer is set in a developing device of a copying machine and is repeatedly used, the spacer effect due to the monodisperse spherical organic resin minute particles is exerted at an early stage, and better developability and transferability are exhibited, but due to stress applied to the toner in a developing device over time, the form of the monodisperse spherical resin minute particle is gradually changed from spherical to a flat shape, sufficient spacer effect is lost, and developability and transferability are deteriorated.

In addition, a reason for limitation to the monodisperse spherical organic resin minute particles is that a refractive index of the monodisperse spherical organic resin minute particles is in the range of 1.4 to 1.6, being approximately the same as a range of 1.4 to 1.6 which is a refractive index of the coloring particles. Since both refractive indices are the same, on a fixed image, light scattering is little at an interface between the coloring particle and the monodisperse spherical organic resin minute particle external additive, and color purity of a full color image and light transmittance on an OHP sheet are excellent.

The monodisperse spherical organic resin minute particles in the invention can be obtained, for example, by drying an emulsion obtained by emulsion-copolymerizing a styrene type monomer and a monomer having two or more ethylenic unsaturated groups in a molecule in water or a dispersing medium containing water as a main component. It is preferable that water used as the dispersing medium is ion-exchanged water or pure water. In addition, the dispersing medium containing water as a main component means a mixed aqueous solution of water, an organic solvent such as methanol, a surfactant and an emulsifying agent or a water-soluble polymer protecting colloid such as polyvinyl alcohol.

The aforementioned surfactant, emulsifying agent, protecting colloid or the like may be reactive or non-reactive as far as accomplishment of the objects of the invention are not prevented. In addition, these surfactant, emulsifying agent, protecting colloid or the like may be used alone, or two or more of them may be used concomitantly.

Examples of the reactive surfactant include an anionic reactive surfactant and a nonionic reactive surfactant in which a radical polymerizable propenyl group is introduced. These reactive surfactants may be used alone, or two or more of them may be used concomitantly.

Examples of the styrene type monomer used in the invention include styrene, α-methylstyrene, β-methylstyrene, o-methylstyrene, m-methylstyrene, p-methylstyrene, p-ethylstyrene, 2,4-dimethylstyrene, 2,5-dimethylstyrene, 3,4-dimethylstyrene, 3,5-dimethylstyrene, 2,4,5-trimethylstyrene, 2,4,6-trimethylstyrene, p-n-butylstyrene, p-t-butylstyrene, p-n-hexylstyrene, p-n-octylstyrene, p-n-dodecylstyrene, p-methoxystyrene, p-phenylstyrene, p-chlorostyrene, 3,4-dichlorostyrene, potassium styrenesulfonate and the like. Inter alia, styrene is suitably used. These styrene type monomers may be used alone, or two or more of them may be used concomitantly.

In addition, examples of the monomer having two or more ethylenic unsaturated groups in a molecule used in the invention (hereinafter, simply abbreviated as "ethylenic unsaturated group-containing monomer") include divinylbenzene, divinyltoluene, ethyreneglycol di(meth)acrylate, ethyleneoxide di(meth)acrylate, tetraethylene oxide di(meth)acrylate, 1,6-hexanediol diacrylate, neopentyl glycol diacrylate, trimethylolpropane tri(meth)acrylate, tetramethylolmethane triacrylate, tetramethylolpropane tetra (meth)acrylate and the like. These ethylenic unsaturated group-containing monomers may be used alone, or two or more of them may be used concomitantly. As used herein, "(meth)acrylate" means "acrylate" or "methacrylate".

The ethylenic unsaturated group-containing monomer functions as a cross-linking monomer, and contributes to improvement in a gel fraction of the resulting minute particles.

A copolymerization ratio of the styrene type monomer and the ethylenic unsaturated group-containing monomer is not particularly limited, but a ratio of the ethylenic unsaturated group-containing monomer is preferably 0.5 parts by mass or more relative to 100 parts by mass of the styrene type monomer. When the ratio of the ethylenic unsaturated group-containing monomer relative to 100 parts by mass of the styrene type monomer is smaller than 0.5 parts by mass, a gel fraction of the obtained minute particles is not sufficiently improved in some cases.

In the invention, in order to induce and promote emulsion copolymerization by a radical polymerization reaction between the styrene type monomer and the ethylenic unsaturated group-containing monomer, a polymerization initiator may be used.

Examples of the polymerization initiator include aqueous hydrogen peroxide, and persulfate salts such as ammonium persulfate, potassium persulfate, sodium persulfate and the like. These polymerization initiators may be used alone, or two or more of them may be used concomitantly.

A method of preparing an emulsion for obtaining the monodisperse spherical organic minute particles in the invention is not particularly limited, but for example, the method may be implemented by the following procedures.

Water or a dispersing medium containing water as a main component, a styrene type monomer and an ethylenic unsaturated group-containing monomer are charged, in predetermined amounts, into a reaction vessel such as a separable flask provided with a stirrer, a nitrogen introducing tube or a reflux condenser, a temperature is raised to about 70° C. at a constant stirring state under an inert gas stream such as nitrogen gas, and a polymerization initiator is added to initiate emulsion copolymerization by a radical polymerization reaction. Thereafter, a temperature of the reaction system is maintained at about 70° C., and emulsion copolymerization is completed in about 24 hours, whereby, the desired emulsion can be obtained.

For the purpose of adjusting a pH, hydrochloric acid, acetic acid, other acid, or alkali such as sodium hydroxide may be added to the emulsion after completion of this polymerization. Then, the emulsion obtained above can be dried by a drying method such as a freeze-drying method or a spray drying method to obtain the monodisperse spherical organic minute particles used in the invention.

In the toner for electrostatic latent image development of the invention, as the external additive, the aforementioned monodisperse spherical silica and the aforementioned monodisperse spherical organic minute particles can be used concomitantly. Alternatively, the aforementioned monodisperse spherical organic minute particles and an inorganic compound having a small particle diameter may be used concomitantly. As the inorganic compound having a small particle diameter, known examples thereof can be used. Such examples include silica, alumina, titania, calcium carbonate, magnesium carbonate, calcium phosphate, cerium oxide and the like. Surfaces of these inorganic minute particles may be subjected to a known surface treatment in accordance with objectives.

In particular, inter alia, metatitanic acid $TiO(OH)_2$ does not influence transparency, and can provide a developer excellent in chargeability, environmental stability, flowability, caking resistance, stable negative chargeability, and stable image quality maintenance. In addition, it is preferable that a hydrophobicization treating compound of the aforementioned metatitanic acid has an electric resistance of $10^{10}$ Ω·cm or more. By rendering an electric resistance in this range, when the compound is treated to the coloring particles and is used in the toner, high transferability can be obtained without occurrence of a reverse polar toner even when the transfer electric field is increased.

The aforementioned inorganic compound having a small particle diameter has a number average particle diameter of, preferably 80 nm or less, and more preferably 50 nm or less.

In the invention, the aforementioned external additive is added to and mixed with a coloring particle. Mixing can be performed by a known mixing machine such as a V-type blender, a HENSCHEL MIXER, Redige mixer or the like.

In addition, at this time, various additives may be added as necessary. Examples of the additives include other flowing agents, and cleaning aids or transfer aids such as polystyrene minute particles, polymethyl methacrylate minute particles, polyvinylidene fluoride minute particles and the like.

In the invention, adhesion of the aforementioned inorganic compound (hydrophobicization treating compound such as metatitanic acid) to the surface of a coloring particle may be a simple mechanical adhesion state, or a state of loose adhesion to the surface. In addition, the whole surface of a coloring particle may be covered, or a part of the surface may be covered. An amount of the inorganic compound to be added is preferably in the range of 0.3 to 3 parts by mass, and more preferably in the range of 0.5 to 2 parts by mass, relative to 100 parts by mass of the coloring particles. When the added amount is smaller than 0.3 parts by mass, flowability of the toner is not sufficiently obtained in some cases, and suppression of blocking by heat storage tends to become insufficient. On the other hand, when the added amount is larger than 3 parts by mass, an excessive covering state is caused, excess inorganic oxide moves to a contact member, and secondary disorders are caused in some cases. In addition, after external addition mixing, the toner may be passed through a sieving process.

The toner for electrostatic latent image development of the invention can be suitably prepared by the above-described process, but the invention is not limited to such a process.

<Electrostatic Latent Image Developer>

The electrostatic latent image developer of the invention comprises the aforementioned toner for electrostatic latent image development of the invention and a carrier. In the aforementioned toner for electrostatic latent image development, the aforementioned monodisperse spherical silica or the like is preferably used, and change over time such as embedding and detachment is caused due to stress with the carrier, whereby it becomes difficult to maintain high transfer performance at an early stage in some cases. In particular, since, as an average circularity of the coloring particle becomes larger, an external additive has nowhere to escape and stress is applied uniformly, such a change over time is easily caused. For reducing stress due to a carrier and maintaining high image quality, it is preferable to control a true specific gravity and unsaturated magnetization of the carrier.

The true specific gravity of the carrier is preferably in the range of 3 to 4, and a saturated magnetization under the condition of 5 kOe is preferably 60 emu/g or more. A smaller true specific gravity is advantageous to a stress. However, when the true specific gravity is too small, a magnetic force per carrier particle is reduced, and flight of the carrier to an electrostatic latent image supporting member is caused. For satisfying both of these, when the true specific gravity is 3 or more and the saturated magnetization is 60 emu/g or more, stress is low and carrier flight can be suppressed.

If the true specific gravity is smaller than 3, even when a saturated magnetization is 60 emu/g or more, carrier flight is caused in some cases. By making the true specific gravity 4 or less, stress to the toner can considerably improve transfer maintenance. Therefore, with iron (true specific gravity: 7 to 8), and ferrite or magnetite (true specific gravity: 4.5 to 5), which have been conventionally used, transfer maintenance becomes insufficient in some cases.

By using, as the carrier, a resin-coated carrier having on a core surface thereof a resin-covered layer in which an electrically conductive material is dispersed in matrix resin, even when peeling of a resin covered layer is caused, high image quality can be manifested over a long time without greatly changing a volume resistivity.

Examples of the matrix resin include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer, styrene-acrylic acid copolymer, straight silicone resin comprising an organosiloxane linkage or a modification thereof, fluorine resin, polyester, polyurethane, polycarbonate, phenol resin, amino resin, melamine resin, benzoguanamine resin, urea resin, amide resin, epoxy resin and the like, but are not limited thereto.

Examples of the electrically conductive material include a metal such as gold, silver and copper, titanium oxide, zinc oxide, barium sulfate, aluminium borate, potassium titanate, tin oxide, carbon black and the like, but are not limited thereto. A content of the electrically conductive material is preferably in the range of 1 to 50 parts by mass, and more preferably in the range of 3 to 20 parts by mass, relative to 100 parts by mass of the matrix resin.

Examples of the core material for the carrier include a core material composed of a magnetic powder alone, and a core material obtained by finely dividing a magnetic powder and dispersing the same in a resin. Examples of a method of finely dividing the magnetic powder and dispersing the same in the resin include a method of kneading and grinding the resin and the magnetic powder, a method of melting and spray drying the resin and the magnetic powder, and a method of polymerizing a magnetic powder-containing resin in a solution using a polymerizing process. From the standpoint of control of a true specific gravity of the carrier, and control of a shape of the carrier, it is preferable to use a magnetic powder dispersed-type core material by a polymerizing process in that a degree of freedom is high. It is preferable that the carrier contains the magnetic powder of minute particles in an amount of 80% by mass or more relative to a total weight of the carrier in that carrier flight is less likely to occur. Examples of the magnetic material (magnetic powder) include a magnetic metal such as iron, nickel, cobalt or the like, and a magnetic oxide such as ferrite, magnetite or the like. A volume average particle diameter of the core material is generally in the range of 10 to 500 μm, and preferably in the range of 25 to 80 μm.

Examples of a method of forming the aforementioned resin-covered layer on the surface of the core material for the carrier include an immersing method of immersing the carrier core material in a covering layer-forming solution containing the aforementioned matrix resin, an electrically conductive material and a solvent, a spraying method of spraying the covering layer-forming solution on the surface of the carrier core material, a fluidizing method of spraying the covering layer-forming solution in the state where the carrier core material is floated by flowing air, and a kneader coater method of mixing the carrier core material and the covering layer-forming solution in a kneader coater, and removing the solvent.

The solvent used in the covering layer-forming solution is not particularly limited as far as it dissolves the matrix resin, but for example, aromatic hydrocarbons such as toluene, xylene and the like, ketones such as acetone, methyl ethyl ketone and the like, and ethers such as tetrahydrofuran, dioxane and the like can be used. An average film thickness of the resin-covered layer is usually in the range of 0.1 to 10 μm. In the invention, for manifesting stable volume resistivity over time, the thickness is preferably in the range of 0.5 to 3 μm.

For attaining high image quality, a volume resistivity of the carrier used in the invention is preferably in the range of $10^6$ to $10^{14}$ Ω·cm, and more preferably in the range of $10^8$ to $10^{13}$ Ω·cm, when 1000 V corresponding to an upper limit and a lower limit of a normal developing contrast potential is applied. When the volume resistivity of a carrier is smaller than $10^6$ Ω·cm, the reproducibility of a fine line is deteriorated, and toner fog on a background due to injection of a charge is easily caused. On the other hand, when the volume resistivity of the carrier is larger than $10^{14}$ Ω·cm, the reproducibility of black solids and half tones is deteriorated. In addition, an amount of the carrier that moves to a photosensitive member is increased, which tends to damage the photosensitive member.

In the electrostatic latent image developer of the invention, it is preferable that the aforementioned toner for electrostatic latent image development of the invention is mixed in an amount in a range of 3 to 15 parts by mass relative to 100 parts by mass of the carrier.

<Image Forming Method>

The image forming method of the invention is an image forming method comprising an charging step of charging the surface of an electrostatic latent image supporting member, an electrostatic latent image forming step of forming an electrostatic latent image on the surface of the electrostatic latent image supporting member, a developing step of developing the electrostatic latent image using a developer to form a toner image, a step of transferring the toner imager formed on the surface of an electrostatic latent image supporting member onto the surface of a transfer receiving material, and a cleaning step of removing toner remaining on the surface of the electrostatic latent image supporting member, wherein the cleaning step is a step of removing remaining toner using an electrostatic brush, and the developer is the electrostatic latent image developer of the invention.

The charging step is a step of uniformly charging the surface of the electrostatic latent image supporting member with charging means. Examples of the charging means include a non-contact format charger such as a corotron or a scorotron, and a contact system charger for charging the surface of the electrostatic latent image supporting member by applying a voltage to an electrically conductive member which is contacted with the surface of the electrostatic latent image supporting member, and a charger of any kind of system may be used. However, from the standpoints of reducing an amount of ozone to be generated, friendliness to the environment, and excellent ability to withstand long printing, it is preferable to use a contact charge system charger. In the contact charge system charger, a shape of the electrically conductive member may be any of brush-like, blade-like, pin electrode-like, roller-like and the like, and a roller-like member is preferable.

Regarding the aforementioned charging system, when a process speed as a circumferential speed of an electrostatic latent image holding material is 200 mm/sec or greater, it is preferable to use a non-contact system charger and, when the process speed is less than 200 mm sec, it is preferable to use a contact system charger.

The image forming method of the invention is not particularly limited with respect to the charging step.

The aforementioned electrostatic latent image forming step is a step of exposing the electrostatic latent image supporting member having the uniformly charged surface with exposing means such as a laser optical system or an LED array, to form an electrostatic latent image. The image forming method of the invention is not particularly limited with respect to an exposing format.

The aforementioned developing step is a step of contacting or placing a developer supporting member with a developer layer, which contains at least a toner, formed on the surface thereof, with or close to the surface of the electrostatic latent image supporting member, to adhere a toner particle to an electrostatic latent image of the surface of the electrostatic latent image supporting member, to form a toner image on the surface of the electrostatic latent image supporting member. Developing can be performed using a known format and, examples of a developing format with a two-component developer used in the invention include a cascade format and a magnetic brush format. The image forming method of the invention is not particularly limited with regard to a developing format.

The aforementioned transferring step is a step of transferring the toner image formed on the surface of the electrostatic latent image supporting member onto the transfer receiving material to form a transferred image. In the case of full color image formation, it is preferable that, after each color toner is primarily transferred to an intermediate transferring drum or belt as an intermediate transfer material, the toner is secondarily transferred onto a recording medium such as paper or the like. In addition, from the standpoints of paper versatility and high image quality, it is preferable that, after color toner images of the respective colors are once transferred onto the intermediate transfer material, the color toner images of respective colors are transferred onto a recording medium at once.

As a transferring apparatus for transferring the toner image from a photosensitive member onto the paper or the intermediate transfer material, a corotron can be utilized. Although the corotron is effective as the means for uniformly charging the paper, since it applies a given charge to the paper, which is a material to be recorded on, a high voltage of several kVs must be applied, and a high voltage electric source is necessary. In addition, since ozone is generated by corona discharge, deterioration of rubber parts and the photosensitive member is caused, and therefore, it is preferable to use a contact transferring system of contacting an electrically conductive transferring roll composed of an elastic material with the electrostatic latent image supporting member by pressure, to transfer a toner image onto the paper.

The image forming method of the invention is not particularly limited with regard to the transferring apparatus.

In the invention, by using the aforementioned electrostatic latent image developer of the invention as a developer, not only can high transferability be obtained at an early stage, but the same high transferability obtained at an early stage can also be obtained under stress over time upon long term use.

The aforementioned cleaning step is a step of removing remaining toner that remains as a transfer residue on the surface of the electrostatic latent image supporting member after the aforementioned transferring step. Conventionally, a blade cleaning system has generally been used as cleaning means because that system has high performance stability. However, in the image forming method of the invention, by using the electrostatic latent image developer of the invention, it becomes possible to recover toner remaining on the surface of an electrostatic latent image supporting member using an electrostatic brush, and an abrasion life of a latent image supporting member can be greatly prolonged.

As the aforementioned electrostatic brush, a resin containing an electrically conductive filler such as carbon black, a metal oxide or the like, or a fibrous substance having a surface thereof covered with the electrically conductive filler (electrically conductive brush) can be used, but the electrostatic brush is not limited thereto. In addition, examples of a cleaning method using an electrostatic brush include a method of performing cleaning by applying a voltage to the electrostatic brush and the like.

The image forming method of the invention can include a fixing step in order to fix the toner image transferred to the aforementioned recording medium.

The aforementioned fixing step is a step of fixing the toner image transferred to the surface of the recording medium with a fixing apparatus. As the fixing apparatus, a heating and fixing apparatus using a heating roll is preferably used. For example, the heating and fixing apparatus may comprise a fixing roller provided with a heating heater lamp in the interior of a cylindrical core metal and having a so-called releasing layer formed from a heat resistant resin covering layer or a heat resistant rubber covering layer on its outer circumferential surface, and a press roller or press belt which is disposed in contact with this fixing roller by pressure, and which has a heat resistant elastic material layer formed on an outer circumferential surface of a cylindrical core metal or on the surface of a belt-like substrate. In a process of fixing an unfixed toner image, a recording material on which an unfixed toner image is formed is passed between the fixing roller and the press roller or press belt, whereby, fixation by heat fusing of a binding resin, an additive and the like in a toner is performed.

The image forming method of the invention is not particularly limited with regard to a fixing format.

EXAMPLES

The present invention will be specifically explained by way of Examples below, but the invention is not limited by these Examples.

Preparation of a toner for electrostatic latent image development, a carrier and an electrostatic latent image developing developer used in respective Examples and Comparative Examples, as well as respective measurements were performed by the following methods.

(Measurement of Number Average Particle Diameter, Variation in a Number Average Particle Size, Average Circularity, and Variation in Average Circularity)

A number average particle diameter, a variation in a number average particle size, an average circularity, and a variation in an average circularity of toners were measured with FPIA-2100 manufactured by Sysmex Corporation. In the present apparatus, a format of measuring a particle dispersed in water with a flowing image analyzing method is adopted, and a sucked particle suspension is introduced by a flat sheath flow cell, and is formed into a flat sample stream by a sheath solution. By irradiating the sample stream with the stroboscopic light, a passing particle is picked up as a stationary image with a CCD camera through an objective lens.

A pitched up particle image is subjected to two-dimensional image treatment, and a circle-equivalent diameter and a circularity are calculated from a projected area and a circumferential length. A circle-equivalent diameter is calculated by letting a diameter of a circle having the same area to be a circle-equivalent diameter, from an area of a two-dimensional image, regarding respective photographed particles. Each of at least 5000 of such the photographed particles was subjected to image analysis and statistical treatment, whereby, a number average particle diameter and a variation in a number average particle size were obtained. In addition, regarding a circularity, a circularity was obtained by the following equation with respect to respective photographed particles. In addition, also regarding a circularity, each of at least 5000 of photographed particles was subjected to image analysis and statistical treatment, whereby, an average circularity and a variation in an average circularity were obtained.

$$\text{Circularity}=\text{circle-equivalent diameter circumferential length/circumferential length}=2A^{1/2}\pi/PM$$

(In the Aforementioned Equation, A Represents a Projected Area, and PM Represents a Circumferential Length)

Measurement was performed at HPF mode (high-resolution mode) and a dilution of 1.0. Upon analysis of data, for the purpose of removing measuring noises, a range of number particle diameter analysis was set at 2.0 to 30.1 μm, and a range of circularity analysis was set at 0.40 to 1.00.

(Measurement of Primary Particle Diameter of External Additive and its Standard Deviation)

Measurement of a primary particle diameter of an external additive and its standard deviation was performed using a laser diffraction and scattering format particle size analyzer (HORIBA, Ltd. LA-910).

(Circularity)

As a circularity, a true circularity of Wadell was adopted, and a circularity was obtained by the following equation.

[Mathematical Expression 1]

$$\text{Circularity}=(1)\text{ surface area of sphere having same volume as that of actual particle}/(2)\text{ Surface area of actual particle}$$

In the above equation, a numerator (1) was obtained by calculation from an average particle diameter. In addition, a powder specific surface area measuring apparatus (Shimadzu Corporation SS-100 type) was used to measure a BET specific surface area, which was used as a denominator (2).

(Measurement of True Specific Gravity of External Additive)

A true specific gravity of an external additive was measured using a Le Chatelier specific gravity bottle according to JIS-K-0061, 5-2-1. The procedures were as follows:

(1) About 250 ml of ethyl alcohol is placed into a Le Chatelier specific gravity bottle, and is adjusted so that a meniscus is positioned at a graduation.

(2) A specific gravity bottle is immersed into a constant temperature water bath and, when a solution temperature becomes 20.0±0.2° C., a position of a meniscus is correctly read with a graduation of a specific gravity bottle (precision is 0.025 ml).

(3) About 100 g of a sample is weighed, and the mass is let to be W.

(4) A weighed sample is placed into a specific gravity bottle, and bubbles are removed.

(5) A specific gravity bottle is immersed into a constant temperature water bath and, when a solution temperature becomes 20.0±0.2° C., a position of a meniscus is correctly read with a graduation of a specific gravity bottle (precision is 0.025 ml).

(6) A true specific gravity is calculated by the following equation:

$$D=W/(L2-L1)$$

$$S=D/0.9982$$

In the aforementioned equations, D is a density of a sample (20° C.) (g/cm$^3$), S is a true specific gravity of a sample (20° C.), W is an apparent mass of a sample (g), L1 is a reading of a meniscus before a sample is placed into a specific gravity bottle (20° C.) (ml), L2 is a reading of a meniscus after a sample is placed into a specific gravity bottle (20° C.) (ml), and 0.9982 is a density of water at 20° C. (g/cm$^3$).

(Preparation of Coloring Particle)

| Preparation of resin minute particle dispersion (1) | |
|---|---|
| Styrene | 370 parts by mass |
| n-Butyl acrylate | 30 parts by mass |
| Acrylic acid | 8 parts by mass |
| Dodecanethiol | 24 parts by mass |
| Carbon tetrabromide | 4 parts by mass |

The above respective components were mixed and dissolved, which was emulsion dispersed in a solution in which 6 parts of a nonionic surfactant (NONIPOL 400: manufactured by Sanyo Chemical Industries, Ltd.) and 10 parts of an anionic surfactant (NEOGEN SC: manufactured by Dai-Ichi Kogyo Seiyaku Co., Ltd.) were dissolved in 550 parts by mass of ion-exchanged water, in a flask. Into this was placed 50 parts by mass of ion-exchanged water in which 4 parts of ammonium persulfate was dissolved, while slowly mixing for 20 minutes. After nitrogen substitution, the flask was heated with an oil bath until the contents became 70° C. while stirring the contents of the flask, and emulsion polymerization was continued at that temperature for 4 hours.

As a result, a resin minute particle dispersion (1) in which a resin particle having an average particle diameter of 165 nm, a glass transition temperature (Tg) of 57° C., and a weight average molecular weight of Mw of 13000 was dispersed, was obtained.

| Preparation of resin minute particle dispersion (2) | |
|---|---|
| Styrene | 280 parts by mass |
| n-Butyl acrylate | 120 parts by mass |
| Acrylic acid | 8 parts by mass |

The above respective components were mixed and dissolved, which was emulsion dispersed in a solution in which 6 parts of a nonionic surfactant (NONIPOL 400: manufactured by Sanyo Chemical Industries, Ltd.) and 12 parts of an anionic surfactant (NEOGEN SC: manufactured by Dai-Ichi Kogyo Seiyaku Co., Ltd.) were dissolved in 550 parts by mass of ion-exchanged water, in a flask. Into this was placed 50 parts by mass of ion-exchanged water in which 3 parts of ammonium persulfate was dissolved, while slowly mixing for 10 minutes. After nitrogen substitution, the flask was heated with an oil bath until the contents became 70° C. while stirring the contents of the flask, and emulsion polymerization was continued at that temperature for 5 hours.

As a result, a resin minute particle dispersion (2) in which a resin particle having an average particle diameter of 105 nm, Tg of 53° C., and a weight average molecular weight of Mw of 550000 was dispersed, was obtained.

| Preparation of colorant dispersion (1) | |
|---|---|
| Cyan pigment (C.I. Pigment Blue B15:3) | 70 parts by mass |
| Nonionic surfactant (Nonipol 400: manufactured by Sanyo Chemical Industries, Ltd.) | 5 parts by mass |
| Ion-exchanged water | 200 parts by mass |

The above components were mixed and dissolved, and dispersed for 10 minutes using a homogenizer (ULTRA-TURRAX T50: manufactured by IKA Japan K.K.) to prepare a colorant dispersion (1) in which a colorant (Cyan pigment) particle having an average particle diameter of 220 nm was dispersed.

| Preparation of colorant dispersion (2) | |
|---|---|
| Magneta pigment (C.I. Pigment Red 122) | 70 parts by mass |
| Nonionic surfactant (Nonipol 400: manufactured by Sanyo Chemical Industries, Ltd.) | 5 parts by mass |
| Ion-exchanged water | 200 parts by mass |

The above components were mixed and dissolved, and dispersed for 10 minutes using a homogenizer (ULTRA-TURRAX T50: manufactured by IKA Japan K.K.) to prepare a colorant dispersion (2) in which a colorant (Magenta pigment) particle having an average particle diameter of 210 nm was dispersed.

| Preparation of colorant dispersion (3) | |
|---|---|
| Yellow pigment (C.I. Pigment Yellow 180) | 100 parts by mass |
| Nonionic surfactant (Nonipol 400: manufactured by Sanyo Chemical Industries, Ltd.) | 5 parts by mass |
| Ion-exchanged water | 200 parts by mass |

The above components were mixed and dissolved, and dispersed for 10 minutes using a homogenizer (ULTRA-TURRAX T50: manufactured by IKA Japan K.K.) to prepare a colorant dispersion (3) in which a colorant (Yellow pigment) particle having an average particle diameter of 250 nm was dispersed.

| Preparation of colorant dispersion (4) | |
|---|---|
| Carbon black (MOGL L: manufactured by Cabot Corporation) | 50 parts by mass |
| Nonionic surfactant (NONIPOL 400: manufactured by Sanyo Chemical Industries, Ltd.) | 5 parts by mass |
| Ion-exchanged water | 200 parts by mass |

The above components were mixed and dissolved, and dispersed for 10 minutes using a homogenizer (ULTRA-TURRAX T50: manufactured by IKA Japan K.K.) to prepare a colorant dispersion (4) in which a colorant (Black pigment) particle was dispersed.

| Preparation of release agent dispersion (1) | |
|---|---|
| Paraffin wax (HNP 0190: manufactured by Nippon Seiro Co., Ltd., melting point: 85° C.) | 50 parts by mass |
| Cationic surfactant (SANISOL B50: manufactured by Kao Corporation) | 5 parts by mass |
| Ion-exchanged water | 200 parts by mass |

The above components were dispersed for 10 minutes in a round-type stainless flask using a homogenizer (ULTRA-TURRAX T50: manufactured by IKA Japan K.K.), and dispersion-treated with a pressure discharge-type homogenizer to prepare a release agent dispersion (1) in which a release agent particle having an average particle diameter of 160 nm was dispersed.

| Preparation of coloring particle 1 | |
|---|---|
| Resin minute particle dispersion (1) | 120 parts by mass |
| Resin minute particle dispersion (2) | 80 parts by mass |
| Colorant dispersion (1) | 200 parts by mass |
| Release agent dispersion (1) | 40 parts by mass |
| Cationic surfactant (SANISOL B50: manufactured by Kao Corporation) | 1.5 parts by mass |

The above respective components were mixed and dispersed with ULTRA-TURRAX T50 (manufactured by IKA Japan K.K.) in a round-type stainless flask, and a temperature was risen to 52° C. for 180 minutes with a heating oil bath while stirring the contents of the flask. After retained at 52° C. for 200 minutes, to this was added 3 parts by mass of an anionic surfactant (NEOGEN RK; manufactured by Dai-ichi Kogyo Seiyaku Co., Ltd.), the stainless flask was sealed, heated to 97° C. while stirring was continued using a magnetic sealing, and retained at 97° C. for 5 hours. After cooled, the reaction product was filtered, sufficiently washed with ion-exchanged water, and dried to obtain a coloring particle 1.

-Preparation of Coloring Particle 2-

According to the same manner as that for preparation of the coloring particle 1 except that a colorant dispersion (2) was used in place of the colorant dispersion (1) in preparation of the coloring particle 1, a coloring particle 2 was obtained.

-Preparation of Coloring Particle 3-

According to the same manner as that for preparation of the coloring particle 1 except that a colorant dispersion (3) was used in place of the colorant dispersion (1) in preparation of the coloring particle 1, a coloring particle 3 was obtained.

-Preparation of Coloring Particle 4-

According to the same manner as that for preparation of the coloring particle 1 except that a colorant dispersion (4) was used in place of the colorant dispersion (1) in preparation of the coloring particle 1, a coloring particle 4 was obtained.

| Preparation of coloring particle 5 | |
|---|---|
| Resin minute particle dispersion (1) | 100 parts by mass |
| Resin minute particle dispersion (2) | 100 parts by mass |

-continued

| Preparation of coloring particle 5 | |
|---|---|
| Colorant dispersion (1) | 250 parts by mass |
| Release agent dispersion (1) | 40 parts by mass |
| Cationic surfactant (SANISOL B50: manufactured by Kao Corporation) | 1.5 parts by mass |

The above respective components were mixed and dispersed with ULTRA-TURRAX T50 (manufactured by IKA Japan K.K.) in a round-type stainless flask, and a temperature was risen to 48° C. for 300 minutes with a heating oil bath while stirring the contents of the flask. Further, a temperature was risen from 48° C. to 52° C. for 100 minutes. After retained at 52° C. for 200 minutes, to this was added 3 parts by mass of an anionic surfactant (NEOGEN RK; manufactured by Dai-ichi Kogyo Seiyaku Co., Ltd.), the stainless flask was sealed, heated to 90° C. while stirring was continued using a magnetic sealing, and retained at 90° C. for 5 hours. After cooled, the reaction product was filtered, sufficiently washed with ion-exchanged water, and dried to obtain a coloring particle 5.

-Preparation of Coloring Particle 6-

According to the same manner as that for preparation of the coloring particle 5 except that a colorant dispersion (2) was used in place of the colorant dispersion (1) in preparation of the coloring particle 5, a coloring particle 6 was obtained.

-Preparation of Coloring Particle 7-

According to the same manner as that for preparation of the coloring particle 5 except that a colorant dispersion (3) was used in place of the colorant dispersion (1) in preparation of the coloring particle 5, a coloring particle 7 was obtained.

-Preparation of Coloring Particle 8-

According to the same manner as that for preparation of the coloring particle 5 except that a colorant dispersion (4) was used in place of the colorant dispersion (1) in preparation of the coloring particle 5, a coloring particle 8 was obtained.

| Preparation of coloring particle 9 | |
|---|---|
| Resin minute particle dispersion (1) | 80 parts by mass |
| Resin minute particle dispersion (2) | 120 parts by mass |
| Colorant dispersion (1) | 200 parts by mass |
| Release agent dispersion (1) | 60 parts by mass |
| Cationic surfactant (SANISOL B50: manufactured by Kao Corporation) | 1.5 parts by mass |

The above respective components were mixed and dispersed with ULTRA-TURRAX T50 (manufactured by IKA Japan K.K.) in a round-type stainless flask, and a temperature was risen to 56° C. for 30 minutes with a heating oil bath while stirring the contents of the flask. After retained at 56° C. for 120 minutes, to this was added 3 parts by mass of an anionic surfactant (NEOGEN RK; manufactured by Dai-ichi Kogyo Seiyaku Co., Ltd.), the stainless flask was sealed, heated to 85° C. while stirring was continued using a magnetic sealing, and retained at 85° C. for 5 hours. After cooled, the reaction product was filtered, sufficiently washed with ion-exchanged water, and dried to obtain a coloring particle 9.

-Preparation of Coloring Particle 10-

According to the same manner as that for preparation of the coloring particle 9 except that a colorant dispersion (2) was used in place of the colorant dispersion (1) in preparation of the coloring particle 9, a coloring particle 10 was obtained.

-Preparation of Coloring Particle 11-

According to the same manner as that for preparation of the coloring particle 9 except that a colorant dispersion (3) was used in place of the colorant dispersion (1) in preparation of the coloring particle 9, a coloring particle 11 was obtained.

-Preparation of Coloring Particle 12-

According to the same manner as that for preparation of the coloring particle 9 except that a colorant dispersion (4) was used in place of the colorant dispersion (1) in preparation of the coloring particle 9, a coloring particle 12 was obtained.

| Preparation of coloring particle 13 | |
|---|---|
| Resin minute particle dispersion (1) | 100 parts by mass |
| Resin minute particle dispersion (2) | 100 parts by mass |
| Colorant dispersion (1) | 200 parts by mass |
| Release agent dispersion (1) | 60 parts by mass |
| Cationic surfactant (SANISOL B50: manufactured by Kao Corporation) | 1.5 parts by mass |

The above respective components were mixed and dispersed with ULTRA-TURRAX T50 (manufactured by IKA Japan K.K.) in a round-type stainless flask, and a temperature was risen to 56° C. for 100 minutes with a heating oil bath while stirring the contents of the flask. After retained at 56° C. for 120 minutes, to this was added 3 parts by mass of an anionic surfactant (NEOGEN RK; manufactured by Dai-ichi Kogyo Seiyaku Co., Ltd.), the stainless flask was sealed, heated to 90° C. while stirring was continued using a magnetic sealing, and retained at 90° C. for 3 hours. After cooled, the reaction product was filtered, sufficiently washed with ion-exchanged water, and dried to obtain a coloring particle 13.

-Preparation of Coloring Particle 14-

According to the same manner as that for preparation of the coloring particle 13 except that a colorant dispersion (2) was used in place of the colorant dispersion (1) in preparation of the coloring particle 13, a coloring particle 14 was obtained.

-Preparation of Coloring Particle 15-

According to the same manner as that for preparation of the coloring particle 13 except that a colorant dispersion (3) was used in place of the colorant dispersion (1) in preparation of the coloring particle 13, a coloring particle 15 was obtained.

-Preparation of Coloring Particle 16-

According to the same manner as that for preparation of the coloring particle 13 except that a colorant dispersion (4) was used in place of the colorant dispersion (1) in preparation of the coloring particle 13, a coloring particle 16 was obtained.

-Preparation of Coloring Particle 17-

The coloring particle 1 was classified into a minute particle and a crude particle with a wind power classifier to obtain a coloring particle 17.

-Preparation of Coloring Particle 18-

The coloring particle 2 was classified into a minute particle and a crude particle with a wind power classifier to obtain a coloring particle 18.

-Preparation of Coloring Particle 19-

The coloring particle 3 was classified into a minute particle and a crude particle with a wind power classifier to obtain a coloring particle 19.

-Preparation of Coloring Particle 20-

The coloring particle 4 was classified into a minute particle and a crude particle with a wind power classifier to obtain a coloring particle 20.

-Preparation of Coloring Particle 21-

The coloring particle 5 was classified into a minute particle and a crude particle with a wind power classifier to obtain a coloring particle 21.

-Preparation of Coloring Particle 22-

The coloring particle 6 was classified into a minute particle and a crude particle with a wind power classifier to obtain a coloring particle 22.

-Preparation of Coloring Particle 23-

The coloring particle 7 was classified into a minute particle and a crude particle with a wind power classifier to obtain a coloring particle 23.

-Preparation of Coloring Particle 24-

The coloring particle 8 was classified into a minute particle and a crude particle with a wind power classifier to obtain a coloring particle 24.

-Preparation of Coloring Particle 25-

50 parts by mass of the coloring particle 17 and 50 parts by mass of the coloring particle 21 were mixed, and classified into a minute particle and a crude particle with a wind power classifier to obtain a coloring particle 25.

-Preparation of Coloring Particle 26-

50 parts by mass of the coloring particle 18 and 50 parts by mass of the coloring particle 22 were mixed, and classified into a minute particle and a crude particle with a wind power classifier to obtain a coloring particle 26.

-Preparation of Coloring Particle 27-

50 parts by mass of the coloring particle 19 and 50 parts by mass of the coloring particle 23 were mixed, and classified into a minute particle and a crude particle with a wind power classifier to obtain a coloring particle 27.

-Preparation of Coloring Particle 28-

50 parts by mass of the coloring particle 20 and 50 parts by mass of the coloring particle 24 were mixed, and classified into a minute particle and a crude particle with a wind power classifier to obtain a coloring particle 28.

-Preparation of Coloring Particle 29-

50 parts by mass of a coloring particle obtained by classifying a minute particle of the coloring particle 9 with a wind power classifier, and 30 parts by mass of the coloring particle 17 were mixed to obtain a coloring particle 29.

-Preparation of Coloring Particle 30-

70 parts by mass of a coloring particle obtained by classifying a minute particle of the coloring particle 10 with a wind power classifier, and 30 parts by mass of the coloring particle 18 were mixed to obtain a coloring particle 30.

-Preparation of Coloring Particle 31-

70 parts by mass of a coloring particle obtained by classifying a minute particle of the coloring particle 11 with a wind power classifier, and 30 parts by mass of the coloring particle 19 were mixed to obtain a coloring particle 31.

-Preparation of Coloring Particle 32-

70 parts by mass of a coloring particle obtained by classifying a minute particle of the coloring particle 12 with a wind power classifier, and 30 parts by mass of the coloring particle 20 were mixed to obtain a coloring particle 32

A number average particle diameter, a variation in a number average particle diameter, an average circularity and a variation in a circularity of these coloring particles are summarized in Table 1.

TABLE 1

| | Number average particle diameter (μm) | Variation in number average particle diameter | Average circularity | Variation in circularity |
|---|---|---|---|---|
| Coloring particle 1 | 5.45 | 23.6 | 0.977 | 2.33 |
| Coloring particle 2 | 5.32 | 22.7 | 0.978 | 2.25 |
| Coloring particle 3 | 5.60 | 20.8 | 0.979 | 2.38 |
| Coloring particle 4 | 5.48 | 21.8 | 0.979 | 2.18 |
| Coloring particle 5 | 6.53 | 19.5 | 0.986 | 1.58 |
| Coloring particle 6 | 6.74 | 18.7 | 0.985 | 1.54 |
| Coloring particle 7 | 6.65 | 18.0 | 0.983 | 1.68 |
| Coloring particle 8 | 6.66 | 19.2 | 0.984 | 1.72 |
| Coloring particle 9 | 6.82 | 23.0 | 0.964 | 2.93 |
| Coloring particle 10 | 6.70 | 24.5 | 0.965 | 2.78 |
| Coloring particle 11 | 6.70 | 23.8 | 0.960 | 2.60 |
| Coloring particle 12 | 6.82 | 22.2 | 0.958 | 2.64 |
| Coloring particle 13 | 6.03 | 23.8 | 0.976 | 2.78 |
| Coloring particle 14 | 6.12 | 21.0 | 0.979 | 2.73 |
| Coloring particle 15 | 5.98 | 20.9 | 0.978 | 2.79 |
| Coloring particle 16 | 5.84 | 22.9 | 0.975 | 2.70 |
| Coloring particle 17 | 4.54 | 24.8 | 0.980 | 2.20 |
| Coloring particle 18 | 4.32 | 23.9 | 0.981 | 2.19 |
| Coloring particle 19 | 4.21 | 24.0 | 0.984 | 2.10 |
| Coloring particle 20 | 4.65 | 22.9 | 0.982 | 2.19 |
| Coloring particle 21 | 8.50 | 23.6 | 0.980 | 1.90 |
| Coloring particle 22 | 8.30 | 23.8 | 0.977 | 1.88 |
| Coloring particle 23 | 8.21 | 22.0 | 0.978 | 1.95 |
| Coloring particle 24 | 8.43 | 24.8 | 0.979 | 1.98 |
| Coloring particle 25 | 5.99 | 31.5 | 0.982 | 2.01 |
| Coloring particle 26 | 5.82 | 28.5 | 0.981 | 1.90 |
| Coloring particle 27 | 5.75 | 29.6 | 0.982 | 1.98 |
| Coloring particle 28 | 6.01 | 30.0 | 0.979 | 2.10 |
| Coloring particle 29 | 7.25 | 32.5 | 0.958 | 3.28 |
| Coloring particle 30 | 7.08 | 29.5 | 0.955 | 3.05 |
| Coloring particle 31 | 7.20 | 28.6 | 0.959 | 2.87 |
| Coloring particle 32 | 7.15 | 30.0 | 0.960 | 2.92 |

(Preparation of External Additive)

-Preparation of External Additive 1 (Monodisperse Spherical Silica)-

Silica sol obtained by a sol-gel process was subjected to HMDS treatment, and dried and ground to obtain an external additive 1 which is monodisperse spherical silica having a true specific gravity of 1.30, a circularity ψ of 0.85 and a number average particle diameter $D_{add}$ of 135 nm (standard deviation: 29 nm).

-Preparation of External Additive 2-

As the external additive 2, commercially available fumed silica RX50 (manufactured by Nippon Aerosil Co., Ltd.; true specific gravity: 2.2, circularity ψ: 0.58, number average particle diameter $D_{add}$: 40 nm (standard deviation 20 nm)) was prepared.

-Preparation of External Additive 3 (Monodisperse Spherical Organic Resin Minute Particle)-

1000 parts by mass of ion-exchanged water, 100 parts by mass of styrene, 50 parts by mass of trimethylolpropane tri(meth)acrylate, and 0.1 parts by mass of a reactive surfactant (trade name "HS-10", manufactured by Dai-ichi Kogyo Seiyaku Co., Ltd.) were charged into a separable flask having an internal volume of 2000 mL provided with a stirrer, a nitrogen introducing tube and a reflux condenser, and a temperature was risen to 70° C. in the constant stirring state under a nitrogen gas stream. After 30 minutes, 0.7 parts by mass of ammonium persulfate as a polymerization initiator was added thereto to initiate emulsion polymerization by a radical polymerization reaction. Thereafter, a temperature of a reaction system was maintained at 70° C., and emulsion polymerization was completed in about 24 hours to prepare an emulsion. Thereafter, nitric acid having the 1% by mass concentration was added dropwise thereto to adjust pH to 4.0. Then, a lyophilizer was used to dry the above-obtained emulsion overnight to obtain an external additive 3 which is a monodisperse spherical organic resin minute particle having a true specific gravity of 1.2 and a number average particle diameter $D_{add}$ of 150 nm.

-External Additive 4-

As the external additive 4, a hydrophobicization-treated titanium oxide particle (manufactured by TITAN KOGYO KABUSHIKI KAISHA; true specific gravity: 4.1, circularity ψ: 0.35, number average particle diameter $D_{add}$: 15 nm) was prepared.

-Preparation of External Additive 5(Monodisperse Spherical Silica)-

Silica sol obtained by a sol-gel process was subjected to HMDS treatment, and dried and ground to obtain an external additive 4 which is monodisperse spherical silica having a true specific gravity of 1.30, a circularity ψ of 0.85, and a number average particle diameter $D_{add}$ of 400 nm (standard deviation: 48 nm).

| (Preparation of carrier) | |
|---|---|
| Ferrite particle (volume average particle diameter: 50 μm) | 100 parts by mass |
| Toluene | 14 parts by mass |
| Styrene-methacrylate copolymer (component ratio: 90/10, Mw: 80000) | 2 parts by mass |
| Carbon black (R330: manufactured by Cabot Corporation) | 0.2 parts by mass |

First, the above components except for the ferrite particle were stirred with a stirrer for 10 minutes to prepare a dispersed covering solution, then, this covering solution and the ferrite particle were placed into a vacuum degassing-type kneader, stirred at 60° C. for 30 minutes, degassed by evacuating while warmed and dried to obtain a carrier. This carrier had a volume resistivity of $10^{11}$ Ωcm at application of the electric field of 1000 V/cm.

EXAMPLE 1

2 parts by mass of the external additive 2 and 2 parts by mass of the external additive 4 were added to each 100 parts by mass of coloring particles 1 to 4, Black, Cyan, Magenta and Yellow toners, the materials were blended for 15 minutes at a circumferential rate of 32 m/s using a HENSCHEL MIXER, and crude particles were removed using a 45 μm mesh sieve to obtain a toner.

Each 100 parts by mass of the aforementioned carrier was added to each 5 parts by mass of the aforementioned toners, the materials were stirred at 40 rpm for 20 minutes using a V-blender, and classified with a sieve having a 177 μm mesh to obtain a developer 1 of one set of four colors.

EXAMPLE 2

According to the same manner as that of Example 1 except that the external additive 1 was used in place of the external additive 2 in Example 1, a developer 2 of one set of four colors was obtained.

EXAMPLE 3

2 parts by mass of the external additive 1 and 2 parts by mass of the external additive 4 were added to each 100 parts by mass of coloring particles 5 to 8, Black, Cyan, Magenta and Yellow toners, the materials were blended for 12 minutes at a circumferential rate of 32 m/s using a HENSCHEL MIXER, and crude particles were removed using a 45 μm mesh sieve to obtain a toner.

Each 100 parts by mass of the aforementioned carrier was added to each 5 parts by mass of the aforementioned toners, the materials were stirred at 40 rpm for 20 minutes using a V-blender, and classified with a sieve having a 177 μm mesh to obtain a developer 3 of one set of four colors.

EXAMPLE 4

According to the same manner as that of Example 3 except that the external additive 3 was used in place of the external additive 1 in Example 3, a developer 4 of one set of four colors was obtained.

Comparative Example 1

According to the same manner as that of Example 1 except that coloring particles 9 to 12 were used in place of coloring particles 1 to 4 in Example 1, a developer 5 of one set of four colors was obtained.

Comparative Example 2

According to the same manner as that of Example 1 except that coloring particles 13 to 16 were used in place of coloring particles 1 to 4 in Example 1, a developer 6 of one set of four colors was obtained.

Comparative Example 3

According to the same manner as that of Example 1 except that coloring particles 25 to 28 were used in place of coloring particles 1 to 4 in Example 1, a developer 7 of one set of four colors was obtained.

Comparative Example 4

According to the same manner as that of Comparative Example 2 except that the external additive 5 was used in place of the external additive 1 in Comparative Example 2, a developer 8 of one set of four colors was obtained.

Comparative Example 5

According to the same manner as that of Example 2 except that coloring particles 29 to 32 were used instead of coloring particles 13 to 16 in Example 2, a developer 9 of one set of four colors is obtained.

(Machine Assessment in System Using Neither Contact Charger Nor Intermediate Transfer Material)

Using the aforementioned developers 1 to 9 and modifying a photosensitive member cleaning blade of A-COLOR 935 manufactured by Fuji Xerox Co., Ltd. into a cleaning brush system (applied voltage: 400 V), the transferability was assessed.

The aforementioned modified A-COLOR 953 is an image forming apparatus, comprising an electrostatic latent image supporting member, charging means for charging the surface of the electrostatic latent image supporting member, electrostatic latent image forming means for forming an electrostatic latent image on the surface of the charged electrostatic latent image supporting member, a developing device for developing the electrostatic latent image with a layer of a developer formed on the surface of a developer supporting member to form a toner image on the surface of the electrostatic latent image supporting member in which a developer comprising a toner and a supporting member to is accommodated in the interior thereof, and transferring means for transferring the toner image onto an intermediate transfer material. A process speed (circumferential rate of latent image supporting member) was 110 mm/s.

First, each developer having the toner concentration of 5% by mass was accommodated into a developing device of the aforementioned image forming apparatus, and allowed to stand for 24 hours under the environment of a temperature of 30° C. and a humidity of 90% RH. Thereafter, the developing conditions were set so that a developing amount of a toner of each color on the surface of a photosensitive member can be maintained in the range of 40 to 50 g/m$^2$ at assessment. For assessing the transferability, under the environment of temperature of 30° C. and a humidity of 90% RH, a machine was stopped at completion of a transferring step, toners at two places having a constant area on the surface of a photosensitive member were transferred onto an adhesive tape, a mass of a tape with a toner adhered thereto was measured, a mass of a tape was subtracted and, thereafter, the values were averaged to obtain an amount of a transferred toner (a) and obtained an amount of a toner remaining on the surface of a photosensitive member (b) similarly and transfer efficiency was obtained by following equation.

$$\text{Transfer efficiency } \eta(\%)=[a/(a+b)]\times 100$$

The target transfer efficiency was 99% or more, and assessment was performed according to the following criteria:

$\eta \geqq 99\%$ . . . ○

$90\% \leqq \eta < 99\%$ . . . Δ

$\eta < 90\%$ . . . ×

For assessing transfer, the process black color by which overlapped aforementioned four colors are expressed, was selected. Upon this, a developing amount on the surface of a photosensitive member was in the range of 160 to 200 g/m$^2$.

The transfer efficiency and the image quality at an early stage and after 10,000 copies were assessed. As the image quality, the presence or the absence of scattering of letters and occurrence of the image ghost were assessed. The results are summarized in Table 2 and Table 3.

TABLE 2

| | | Number average particle diameter (μm) | Variation in number average particle diameter | Average circularity | Variation in circularity | External additive true specific gravity | D50/Dad | Early stage transfer efficiency (%) | After 10,000 copies transfer efficiency (%) |
|---|---|---|---|---|---|---|---|---|---|
| Example 1 | Coloring particle 1 | 5.45 | 23.6 | 0.977 | 2.33 | 2.2 | 136.3 | 95.8 | 92.3 |
| | Coloring particle 2 | 5.32 | 22.7 | 0.978 | 2.25 | 2.2 | 133.0 | | |
| | Coloring particle 3 | 5.60 | 20.8 | 0.979 | 2.38 | 2.2 | 140.0 | | |
| | Coloring particle 4 | 5.48 | 21.8 | 0.979 | 2.18 | 2.2 | 137.0 | | |
| Example 2 | Coloring particle 1 | 5.45 | 23.6 | 0.977 | 2.33 | 1.3 | 40.4 | 99.5 | 99 |
| | Coloring particle 2 | 5.32 | 22.7 | 0.978 | 2.25 | 1.3 | 39.4 | | |
| | Coloring particle 3 | 5.60 | 20.8 | 0.979 | 2.38 | 1.3 | 41.5 | | |
| | Coloring particle 4 | 5.48 | 21.8 | 0.979 | 2.18 | 1.3 | 40.6 | | |
| Example 3 | Coloring particle 1 | 5.45 | 23.6 | 0.977 | 2.33 | 1.2 | 36.3 | 99.2 | 99.2 |
| | Coloring particle 2 | 5.32 | 22.7 | 0.978 | 2.25 | 1.2 | 35.5 | | |
| | Coloring particle 3 | 5.60 | 20.8 | 0.979 | 2.38 | 1.2 | 37.3 | | |
| | Coloring particle 4 | 5.48 | 21.8 | 0.979 | 2.18 | 1.2 | 36.5 | | |
| Example 4 | Coloring particle 5 | 6.53 | 19.5 | 0.986 | 1.58 | 1.3 | 48.4 | 99.9 | 99.6 |
| | Coloring particle 6 | 6.74 | 18.7 | 0.985 | 1.54 | 1.3 | 49.9 | | |
| | Coloring particle 7 | 6.65 | 18.0 | 0.983 | 1.68 | 1.3 | 49.3 | | |
| | Coloring particle 8 | 6.66 | 19.2 | 0.984 | 1.72 | 1.3 | 49.3 | | |

TABLE 3

| | | Number average particle diameter (μm) | Variation in number average particle diameter | Average circularity | Variation in circularity | External additive true specific gravity | D50/Dad | Early stage transfer efficiency (%) | After 10,000 copies transfer efficiency (%) |
|---|---|---|---|---|---|---|---|---|---|
| Comparative Example 1 | Coloring particle 9 | 6.82 | 23.0 | 0.964 | 2.93 | 2.2 | 170.5 | 85.9 | 78.8 |
| | Coloring particle 10 | 6.70 | 24.5 | 0.965 | 2.78 | 2.2 | 167.5 | | |
| | Coloring particle 11 | 6.70 | 23.8 | 0.96 | 2.60 | 2.2 | 167.5 | | |
| | Coloring particle 12 | 6.82 | 22.2 | 0.958 | 2.64 | 2.2 | 170.5 | | |
| Comparative Example 2 | Coloring particle 13 | 6.03 | 23.8 | 0.976 | 2.78 | 2.2 | 150.8 | 95.8 | 88.9 |
| | Coloring particle 14 | 6.12 | 21.0 | 0.979 | 2.73 | 2.2 | 153.0 | | |
| | Coloring particle 15 | 5.98 | 20.9 | 0.978 | 2.79 | 2.2 | 149.5 | | |
| | Coloring particle 16 | 5.84 | 22.9 | 0.975 | 2.70 | 2.2 | 146.0 | | |
| Comparative Example 3 | Coloring particle 25 | 5.99 | 35.8 | 0.980 | 2.01 | 2.2 | 149.8 | 94.3 | 88.6 |
| | Coloring particle 26 | 5.82 | 34.5 | 0.979 | 1.90 | 2.2 | 145.5 | | |
| | Coloring particle 27 | 5.75 | 33.5 | 0.982 | 1.98 | 2.2 | 143.8 | | |
| | Coloring particle 28 | 6.01 | 33.5 | 0.980 | 2.10 | 2.2 | 150.3 | | |
| Comparative Example 4 | Coloring particle 13 | 6.03 | 23.8 | 0.976 | 2.78 | 1.3 | 15.1 | 94.8 | 78.9 |
| | Coloring particle 14 | 6.12 | 21.0 | 0.979 | 2.73 | 1.3 | 15.3 | | |
| | Coloring particle 15 | 5.98 | 20.9 | 0.978 | 2.79 | 1.3 | 14.9 | | |
| | Coloring particle 16 | 5.84 | 22.9 | 0.975 | 2.70 | 1.3 | 14.6 | | |
| Comparative Example 5 | Coloring particle 29 | 7.25 | 32.5 | 0.958 | 3.28 | 1.3 | 53.7 | 84.8 | 80.5 |
| | Coloring particle 30 | 7.08 | 29.5 | 0.955 | 3.05 | 1.3 | 52.4 | | |
| | Coloring particle 31 | 7.20 | 28.6 | 0.959 | 2.87 | 1.3 | 53.3 | | |
| | Coloring particle 32 | 7.15 | 30.0 | 0.960 | 2.92 | 1.3 | 52.9 | | |

Regarding developers 1 to 4 obtained in Example 1 to 4, the transferability was better not only at an early stage but also after 10,000 copies, and a clear image was exhibited in both cases. A photosensitive member was removed from an apparatus after further 10,000 copies, the surface state was observed visually, and it was found that occurrence of a flaw was little.

On the other hand, in the developer 5 obtained in Comparative Example 1, a circularity of a toner was low and, since the external additive adhesion state on the surface was scattered between toners, the transfer efficiency was relatively low starting from an early stage, and the transfer efficiency after 10,000 copies was low. In the developer 6 in Comparative Example 2, since a variation in a circularity of a toner was high, and a toner near a true sphere and a toner having the high odd-shape degree were many, the transfer efficiency was high at an early stage, but the transfer efficiency after 10,000 copies was low, and the maintenance of transfer was not obtained. In the developer 7 obtained in Comparative Example 3, a variation in a particle diameter of a toner was large, the transfer efficiency at an early stage was high, but the transfer efficiency after 10,000 copies was low. Further, in the developer 8 obtained in Comparative Example 4, since a ratio of a number average particle diameter $D_{TN}$ of a toner and a number average particle diameter $D_{add}$ of a monodisperse spherical particle was smaller than 25, the transfer efficiency at an early stage was high, but after 10,000 copies, since embedding of the external additive into a toner was extreme, the transfer efficiency was low, and maintenance of transfer was not obtained.

In addition, in the developer 9 obtained in Comparative Example 5, since a circularity of a toner was low and a variation in a circularity was high, even when a ratio of a number average particle diameter $D_{TN}$ of a toner and a number average particle diameter $D_{add}$ of a monodisperse spherical particle was 25 or more and 80 or less, the transfer efficiency was low starting from an early stage and, after 10,000 copies, the transfer efficiency was reduced extremely.

(Machine Assessment in System not Using Contact Charger but Using Intermediate Transfer Material)

Using the developer 4 and the developer 10 and modifying a cleaning blade of a photosensitive member of DOCU-COLOR 1255 manufactured by Fuji Xerox Co., Ltd. into a cleaning brush system (applied voltage: 400 V), the transferability was assessed.

The aforementioned modified DOCU-COLOR 1255 is an image forming apparatus, comprising an electrostatic latent image supporting member, charging means for charging the surface of the electrostatic latent image supporting member, electrostatic latent image forming means for forming an electrostatic latent image on the surface of the charged electrostatic latent image supporting member, a developing device for developing the electrostatic latent image with a layer of the developer formed on the surface of a developer supporting member to form a toner image on the surface of the electrostatic latent image supporting member in which a developer comprising a toner and a carrier is accommodated in the interior thereof, and transferring means for transferring the toner image onto an intermediate transfer material. A process speed (circumferential rate of latent image supporting member) was 110 mm/s.

The assessment items and the assessment method were the same as those for the system using neither contact charger nor intermediate transfer material, and the transfer efficiency and the image quality were assessed at an early stage and after 50,000 copies.

As a result, in the developer 4 obtained in Example 4, a clear image was exhibited of course at an early stage, the same clear image as that at an early stage was also exhibited after 5000 copies, and no problem on an image occurred. In addition, the transfer efficiency was 98.8% at an early stage, and 98.6% after 50,000 copies. On the other hand, in the developer 10 obtained in Comparative Example 6, there was no problem at an early stage, but after 50,000 copies, it was confirmed that a transfer residue toner occurs as an image ghost of a next image. In addition, the transfer efficiency was 98.0% at an early stage, and 84.3% after 50,000 copies.

(Machine Assessment in System Using Contact Charger and Intermediate Transfer Material)

Using the developer 4 and the developer 8 and modifying a cleaning blade of a photosensitive member of the aforementioned DOCU-COLOR 1255 manufactured by Fuji Xerox Co., Ltd. into a cleaning brush system, and a non-contact charger into a contact charger, the transferability and an image were assessed.

The assessment items and the assessment method were the same as those for the system using neither contact charger nor intermediate transfer material, and the transfer efficiency and the image quality were assessed at an early stage and after 50,000 copies.

As a result, in the developer 4 obtained in Example 4, a clear image was exhibited of course at an early stage, and the same clear image as that at an early stage was also exhibited after 50,000 copies, and no problem on an image occurred. In addition, the transfer efficiency was 98.8% at an early stage, and 98.2% after 50,000 copies. On the other hand, in the developer 8 obtained in Comparative Example 4, there was no problem at an early stage, but already at a point after 20,000 copies, it was confirmed that a transfer residue toner occurs as an image ghost of a next image. In addition, the transfer efficiency was 98.0% at an early stage, 90.8% after 20,000 copies.

According to the invention, there can provide a toner for electrostatic latent image development which can maintain the high toner transferability over a long term and, in particular, can improve generated disadvantages also in an image forming process having no blade cleaning step of promoting abrasion of an electrostatic latent image supporting member, and using an electrostatic brush to recover a remaining toner on the surface of the electrostatic latent image supporting member, and a process for preparing the same, as well as an electrostatic latent image developer using the toner for electrostatic latent image development. In addition, according to the invention, there can provide an image forming method that allows for development, transfer and fixation in response to the required high image quality.

The invention claimed is:

1. A toner for electrostatic latent image development comprising:

coloring particles containing at least a binding resin, a colorant and a release agent; and an external additive, wherein a variation in a number average particle diameter of the coloring particles is 25 or less, an average circularity of the coloring particles is 0.975 or more, and a variation in a circularity of the coloring particles is 2.5 or less; and wherein as the external additive, at least monodisperse spherical particle having a true specific gravity in a range of 1.0 to 1.9 are used, and a ratio of a number average particle diameter $D_{TN}$ of the coloring particles and a number average particle diameter $D_{add}$ of the monodisperse spherical particles ($D_{TN}/D_{add}$) is in a range of $25 \leqq D_{TN}/D_{add} \leqq 80$.

2. A toner for electrostatic latent image development according to claim 1, wherein the toner is prepared by a chemical process.

3. A toner for electrostatic latent image development according to claim 2, wherein the chemical process is an emulsion polymerization method comprising:

mixing a resin minute particle dispersion, a colorant dispersion and a release agent dispersion, and aggregating the resin minute particles, the colorant particles and the release agent particles to form aggregated particles; and heating the aggregated particles to a temperature not lower than a glass transition temperature of the resin minute particles to fuse and coalesce the particles.

4. A toner for electrostatic latent image development according to claim 1, wherein the external additive is monodisperse spherical silica.

5. A toner for electrostatic latent image development according to claim 4, wherein the monodisperse spherical silica is prepared by a sol-gel process.

6. A toner for electrostatic latent image development according to claim 4, wherein the monodisperse spherical silica is hydrophobicization-treated.

7. A toner for electrostatic latent image development according to claim 1, wherein the external additive is monodisperse spherical organic resin minute particles, and a gel fraction of the monodisperse spherical organic resin minute particles is 70% by mass or more.

8. A toner for electrostatic latent image development according to claim 7, wherein a refractive index of the monodisperse spherical organic resin minute particles is in a range of 1.4 to 1.6.

9. A toner for electrostatic latent image development according to claim 1, wherein a number average particle diameter $D_{TN}$ of the coloring particles is in a range of 5.0 to 7.0 mm.

10. A toner for electrostatic latent image development according to claim 1, wherein a standard deviation for an average particle diameter of the monodisperse spherical particles is the number average particle diameter $D_{add}$×0.22 or less.

11. A process for preparing a toner for electrostatic latent image development, which comprises: mixing a resin minute particle dispersion, a colorant dispersion and a release agent dispersion, and aggregating the resin minute particles, the colorant particles and the release agent particles to form aggregated particles; and heating the aggregated particles to a temperature not lower than a glass transition temperature of the resin minute particles to fuse and coalesce the particles; combining the coalesced particles with external additives; wherein a variation in a number average particle diameter of the coloring particles is 25 or in, an average circularity of the coloring particles is 0.975 or more, and a variation in a clrcularity of the coloring particles is 2.5 or less; and wherein as the external additive, at least monodisperse spherical particle having a true specific gravity in a range of 1.0 to 1.9 are used, and a ratio of a number average particle diameter $D_{TN}$ of the coloring particles and a number average particle diameter $D_{add}$ of the monodisperse spherical particles ($D_{TN}/D_{add}$) is in a range of $25 \leqq D_{TN}/D_{add} 80$.

12. A process for preparing a toner for electrostatic latent image development according to claim 11, which further comprises adding and mixing another minute particle dispersion to adhere the minute particles to surfaces of the aggregated particles, before the aggregated particles are fused and coalesced.

13. A process for preparing a toner for electrostatic latent image development according to claim 11, wherein a temperature for fusing and coalescing the aggregated particles is in a range of 70 to 120° C.

14. A process for preparing a toner for electrostatic latent image development according to claim 11, wherein an average particle diameter of the resin minute particles is 1 mm or less.

15. A process for preparing a toner for electrostatic latent image development according to claim 11, wherein an average particle diameter of the release agent particles is 1 mm or less.

16. A process for preparing a toner for electrostatic latent image development according to claim 11, wherein an average particle diameter of the colorant particles is 0.8 mm or less.

17. An electrostatic latent image developer comprising a toner for electrostatic latent image development and a carrier, the toner for electrostatic latent image development comprising:

coloring particles containing at least a binding resin, a colorant and a release agent; and an external additive, wherein a variation in a number average particle diameter of the coloring particles is 25 or less, an average circularity of the coloring particles is 0.975 or more, and a variation in a circularity of the coloring particles is 2.5 or less; and wherein as the external additive, at least monodisperse spherical particle having a true specific gravity in a range of 1.0 to 1.9 are used, and a ratio of a number average particle diameter $D_{TN}$ of the coloring particles and a number average particle diameter $D_{add}$ of the monodisperse spherical particles ($D_{TN}/D_{add}$) is in a range of $25 \leqq D_{TN}/D_{add} \leqq 80$.

18. An electrostatic latent image developer according to claim 17, wherein a volume resistivity of the carrier is in a range of 106 to 1014 Ω·cm.

19. An image forming method comprising a charging step of charging a surface of an electrostatic latent image supporting member, an electrostatic latent image forming step of forming an electrostatic latent image on the surface of the electrostatic latent image supporting member, a developing step of developing the electrostatic latent image using an electrostatic latent image developer to form a toner image, a transferring step of transferring the toner image formed on the surface of the electrostatic latent image supporting member onto a surface of a transfer receiving material, and a cleaning step of removing toner remaining on the surface of the electrostatic latent image supporting member, wherein: the cleaning step is a step of removing remaining toner using an electrostatic brush; the electrostatic latent image developer comprises a toner for electrostatic latent image development and a carrier; the toner for electrostatic latent image development has coloring particles containing at least a binding resin, a colorant and a release agent, and an external additive; a variation in a number average particle diameter of the coloring particles is 25 or less; an average circularity of the coloring particles is 0.975 or more; and a variation in a circularity of the coloring particles is 2.5 or less; and wherein as the external additive, at least monodisperse spherical particle having a true specific gravity in a range of 1.0 to 1.9 are used, and a ratio of a number average particle diameter $D_{TN}$ of the coloring particles and a number average particle diameter $D_{add}$ of the monodisperse spherical particles ($D_{TN}/D_{add}$) is in a range of $25 \leqq D_{TN}/D_{add} \leqq 80$.

* * * * *